US010247513B1

(12) United States Patent
Goldense et al.

(10) Patent No.: US 10,247,513 B1
(45) Date of Patent: Apr. 2, 2019

(54) LOCKING MECHANISMS FOR AND METHOD OF SECURING FIREARM COMPONENTS IN THE STOCK, BUTT, AND/OR GRIP OF A COLLAPSIBLE FIREARM

(71) Applicants: Bradford L. Goldense, Dedham, MA (US); Thomas W. Bachelder, Holly Springs, NC (US)

(72) Inventors: Bradford L. Goldense, Dedham, MA (US); Thomas W. Bachelder, Holly Springs, NC (US)

(73) Assignee: Bradford L. Goldense, Dedham, MA (US)

( * ) Notice: Subject to any disclaimer, the term of this patent is extended or adjusted under 35 U.S.C. 154(b) by 0 days.

(21) Appl. No.: 15/788,881

(22) Filed: Oct. 20, 2017

(51) Int. Cl.
*F41C 23/22* (2006.01)
*F41A 17/02* (2006.01)
*F41A 11/04* (2006.01)

(52) U.S. Cl.
CPC ..... *F41C 23/22* (2013.01); *F41A 11/04* (2013.01); *F41A 17/02* (2013.01)

(58) Field of Classification Search
CPC ..... F41C 23/22; F41A 11/04; F41A 17/02
USPC ..... 42/70.11, 71.02, 72, 73
See application file for complete search history.

(56) References Cited

U.S. PATENT DOCUMENTS 856,016 A * 6/1907 Balson ..... F41C 23/22 24/506
894,101 A * 7/1908 Balson ..... F41C 23/22 42/71.01
2,298,678 A * 10/1942 Chase ..... F41C 23/22 42/71.01
2,484,168 A * 10/1949 Jachimiec ..... F41C 23/22 42/71.01
2,495,977 A * 1/1950 Madsen ..... F41C 23/22 42/71.01
2,667,005 A * 1/1954 Weis ..... F41C 23/08 42/74
3,618,248 A * 11/1971 Into et al. ..... F41C 23/22 42/71.01
4,261,127 A 4/1981 Karkkainen
5,048,212 A * 9/1991 Mossberg ..... F41A 17/02 42/70.06
5,111,755 A 5/1992 Rouse
5,225,613 A * 7/1993 Claridge ..... F41C 23/22 42/74
5,465,519 A 11/1995 Blanck
5,683,021 A 11/1997 Setina
(Continued)

*Primary Examiner* — Joshua E Freeman

(74) *Attorney, Agent, or Firm* — Ward and Smith, P.A.; Ryan K. Simmons

(57) ABSTRACT

Locking mechanisms for and methods of securing firearm components in the shoulder stock or butt and/or handgrip of a collapsible firearm. In one example, the locking mechanism may include one or more locking members and a locking mechanism. In another example the locking mechanism may include a cylinder lock. The locking mechanism is configured to secure one or more firearm components in place within a storage compartment of the shoulder stock or butt and/or handgrip of the collapsible firearm, and/or to secure an endcap of the collapsible firearm to the shoulder stock or butt and/or handgrip, thereby rendering the storage compartment a locked container, with the one or more firearm components locked therein.

42 Claims, 39 Drawing Sheets

(56) References Cited

U.S. PATENT DOCUMENTS 6,009,996 A 1/2000 Purdy
6,012,246 A * 1/2000 Robinson ..... F41C 23/22 42/71.01
6,134,822 A * 10/2000 Murgel ..... F41A 17/54 42/70.07
6,142,313 A 11/2000 Young
6,260,298 B1 * 7/2001 Bubits ..... F41A 17/64 42/70.08
6,382,002 B1 * 5/2002 Chen ..... F41A 17/44 42/70.06
6,389,728 B1 * 5/2002 Lundy ..... F41A 17/02 42/70.01
6,612,140 B1 * 9/2003 Strassell ..... F41A 17/02 211/4
6,629,379 B1 * 10/2003 Doiron ..... F41A 17/02 42/70.06
6,789,341 B1 * 9/2004 Badura ..... F41A 17/44 128/876
6,804,906 B1 * 10/2004 Olsen ..... F41A 17/44 42/70.11
6,932,221 B2 8/2005 McMurray
7,543,403 B1 * 6/2009 Schaefer ..... F41A 17/02 42/70.02
7,934,297 B2 * 5/2011 Williams ..... B65D 63/1072 24/16 PB
7,971,381 B1 * 7/2011 Mikell ..... F41A 17/54 42/70.11
8,756,849 B2 * 6/2014 Troy ..... A47B 25/003 42/73
9,140,519 B2 * 9/2015 Simpson ..... F41C 23/06
9,784,517 B2 * 10/2017 Pittman ..... F41A 17/02
2002/0112389 A1 * 8/2002 Kellerman ..... F41A 17/44 42/70.11
2002/0121039 A1 * 9/2002 Kellerman ..... F41A 17/44 42/70.11
2002/0162265 A1 * 11/2002 Abad ..... F41A 17/44 42/70.11
2002/0189148 A1 * 12/2002 Hanson ..... F41A 17/44 42/70.11
2002/0194764 A1 * 12/2002 Beretta ..... F41A 17/02 42/70.11
2003/0089016 A1 * 5/2003 Hyytinen ..... F41A 17/02 42/70.11
2003/0136044 A1 * 7/2003 Williams ..... F41A 29/00 42/95
2003/0140541 A1 * 7/2003 Kay ..... F41C 23/22 42/72
2004/0025394 A1 * 2/2004 Young ..... F41A 17/44 42/70.11
2004/0055199 A1 * 3/2004 Chudwin ..... F41A 17/44 42/70.11
2004/0060219 A1 * 4/2004 Weinraub ..... F41A 17/44 42/70.11
2006/0288625 A1 * 12/2006 Williams ..... F41A 17/44 42/70.11
2007/0261284 A1 * 11/2007 Keng ..... F41C 23/04 42/73
2008/0216376 A1 * 9/2008 Pikielny ..... F41A 17/02 42/70.11
2013/0111796 A1 * 5/2013 Dionne ..... F41A 17/00 42/70.11

* cited by examiner

LOCKING MECHANISMS FOR AND METHOD OF SECURING FIREARM COMPONENTS IN THE STOCK, BUTT, AND/OR GRIP OF A COLLAPSIBLE FIREARM

TECHNICAL FIELD

The presently disclosed subject matter relates generally to locking mechanisms for firearms and more particularly to locking mechanisms for and methods of securing firearm components in the stock, butt, and/or grip of a collapsible firearm.

BACKGROUND

Federal law does not restrict licensed individuals from transporting legally acquired firearms across state lines for lawful purposes except those explicitly prohibited by federal law including convicted felons as well as several other classifications of persons. Therefore, no federal permit is required (or available) for the interstate transportation of firearms. However, many states and localities have laws governing the transportation of firearms. Travelers must be aware of these laws and comply with legal requirements in each jurisdiction. There is no uniform state transportation procedure for firearms. As a rule, a traveler should carry firearms unloaded, locked in a secure container other than the glove compartment or console, and stored in an area (such as a trunk, attached toolbox, or other locked container) where they are not readily accessible from a vehicle's passenger compartment. Further, any ammunition should be stored in a separate locked container. Title 18 Part 1 Chapter 44 s926A Accordingly, to satisfy federal and state firearm laws as well as for general safety reasons, firearm owners may have lockable firearm travel (or carrying) cases, of which there are several types. However, these cases come at a significant expense to firearm owners. Further, the cases can be inconvenient to use, store, and carry and therefore firearm owners may neglect to use them albeit at a risk, when traveling interstate or intrastate for personal, business, or recreational purposes. Not all automobiles today have trunks. SUVs did not exist when the statutes were written. As such, practical interpretations are made every day by owners and law enforcement agencies regarding the safe and secure transport of firearms.

Governed by separate federal, state, county, local, and lake-specific laws, watercraft transport and storage pose similar security challenges. Further, so do camping trailers, temporary shelters and tents, backpacking, and/or other activities and conditions where numerous people and children are in close proximity to firearms while traveling or recreating.

Certain types of collapsible firearms cannot be locked without disassembling them. These firearms are frequently transported, used on watercraft, taken camping, and are often left inadequately unsecured in cars and recreational areas. As a result, new approaches are needed to incent and to more easily secure certain firearms in a manner that satisfies federal, state, and other firearm laws as well as satisfies general safety requirements.

SUMMARY

In one embodiment, a locking mechanism for a collapsible firearm is provided. The locking mechanism may include one or more locking members, including a first end and a second end, the first end including a stop, wherein the one or more locking members may be configured to be received by one or more clearance channels formed in one of a shoulder stock, butt, or handgrip of the collapsible firearm, and wherein a first one of the one or more locking members is configured to pass through a first one of the one or more clearance channels from a first side to a second side of the one of the shoulder stock, butt, or handgrip, such that a portion of the second end of the at least one of the one or more locking members protrudes from the second side of the one of the shoulder stock, butt, or handgrip; and a securing mechanism configured to engage with the second end of the first one of the one or more locking members that protrudes from the second side of the one of the shoulder stock, butt, or handgrip. The second end of the first one of the one or more locking members may include a through hole configured to engage with the securing mechanism. The securing mechanism may include any one of a lock, cable tie, or zip tie. The first one of the one or more locking members may be configured to pass through the first one of the one or more clearance channels, such that when installed the first one of the locking member passes through a trigger guard and a front or back side of a trigger of a receiver of the collapsible firearm when in a collapsed configuration and the receiver is stored in the one of the shoulder stock, butt, or handgrip. The locking mechanism may further include a second of the one or more locking members, wherein the second of the one or more locking members, may be configured to pass through a second one of the one or more clearance channels and, when installed, is configured to engage with a magazine of the collapsible firearm when in a collapsed configuration and the magazine is stored in the one of the shoulder stock, butt, or handgrip. The second of the one or more locking members may be configured to engage with the magazine by extending at least partially into a through-hole or notch formed in the magazine. The first one of the one or more locking members may pass through a through-hole formed in a first magazine and through a trigger guard and a front or back side of a trigger of a receiver, and the second of the one or more locking members may engage with a second magazine of the collapsible firearm when in a collapsed configuration and the first and second magazine and receiver are stored in the one of the shoulder stock, butt, or handgrip. The first one of the one or more locking members may be configured such that when it passes through the shoulder stock, butt, or handgrip, and the securing mechanism is engaged with its second end one or more components of the of the collapsible firearm stored therein are secured in place. The locking mechanism may further include a grommet provided at each opening of the one or more clearance channels. The grommet may include a plastic, rubber, silicon, or composite material grommet. The locking grommet may include a waterproof or semi-waterproof grommet, and is configured to provide a waterproof or semi-waterproof seal at each opening of the one or more clearance channels. The stop is preferably larger than the diameter of the one or more clearance channels and is configured to prevent the first end of the one or more locking members from passing through the first side of the one of the shoulder stock, butt, or handgrip.

In another embodiment, a method of forming a clearance channel in a collapsible firearm is provided. The method may include forming the clearance channel through one of a shoulder stock, butt, or handgrip of the collapsible firearm and a storage compartment therein, wherein the clearance channel has a first side opening and a second side opening and passes through a trigger guard and a front or back side of a trigger of a receiver of the collapsible firearm, and wherein the first side opening of the clearance channel on a first side of the shoulder stock, butt, or handgrip is a distance d1 as measured at a right angle from a bottom edge of the shoulder stock, butt, or handgrip and is a distance d1' as measured at a right angle from an edge portion of the storage compartment, and further wherein the second side opening of the clearance channel on a second side of the shoulder stock, butt, or handgrip is a distance d2 as measured at a right angle from the bottom edge of the shoulder stock, butt, or handgrip and is a distance d2' as measured at a right angle from the edge portion of the storage compartment. Distance d1 may be about 35 mm, d1' may be about 31 mm, d2 may be about 43 mm, and d2' may be about 31 mm. The clearance channel passes between the trigger guard and a front side or back side of a trigger of the receiver of the collapsible firearm when in a collapsed configuration and the receiver is stored in the one of the shoulder stock, butt, or handgrip. The method may further include forming a second clearance channel in the one of the shoulder stock, butt, or handgrip of the collapsible firearm and the storage compartment therein, wherein the second clearance channel has at least an opening on the first side, and wherein the second clearance channel opening on the first side of the shoulder stock, butt, or handgrip is a distance d3 as measured at a right angle from a bottom edge of the shoulder stock, butt, or handgrip and is a distance d3' as measured at a right angle from an edge portion of the storage compartment. Distance d1 may be about 51 mm, d1' may be about 31 mm, d2 may be about 43 mm, d2' may be about 31 mm, d3 may be about 68, and d3' may be about 31. The second clearance channel passes through or partially through a magazine of the collapsible firearm when the first magazine is stored in the one of the shoulder stock, butt, or handgrip.

In yet another embodiment, a collapsible firearm with a locking mechanism is provided. The collapsible firearm with a locking mechanism may include a collapsible firearm; and a locking mechanism. The locking mechanism may include one or more locking members, including a first end and a second end, the first end including a stop, wherein the one or more locking members are configured to be received by one or more clearance channels formed in one of a shoulder stock, butt, or handgrip of the collapsible firearm, and wherein a first one of the one or more locking members is configured to pass through a first one of the one or more clearance channels from a first side to a second side of the one of the shoulder stock, butt, or handgrip, such that a portion of the second end of the at least one of the one or more locking members protrudes from the second side of the one of the shoulder stock, butt, or handgrip; and a securing mechanism configured to engage with the second end of the first one of the one or more locking members that protrudes from the second side of the one of the shoulder stock, butt, or handgrip.

In still yet another embodiment, an alternative locking mechanism for a collapsible firearm is provided. The locking mechanism may include a cylinder lock, including a cylinder body; and a cylinder, the cylinder may include a latch mechanism at a first end, wherein the cylinder is rotatable within the cylinder body; and wherein the cylinder lock is configured to be received in an opening formed in a portion of one of a shoulder stock, butt, or handgrip of the collapsible firearm, such that when installed the latch mechanism is lockably engagable with a corresponding latch catch, wherein the latch catch may be formed in an interior portion of a storage compartment of the one of the shoulder stock, butt, or handgrip. The opening may be formed in a side portion of the one of the shoulder stock, butt, or handgrip. When installed the cylinder lock may be substantially aligned with a trigger guard of a receiver of the collapsible firearm stored within the storage compartment of the one of the shoulder stock, butt, or handgrip, and the latch mechanism is further configured to pass through the trigger guard. The latch mechanism may include a hook portion. The latch catch may include one of a slot and cavity configured to be engagable with the latch mechanism when the cylinder lock is installed. The cylinder may further include a key slot configured such that when engaged by a corresponding key the cylinder is rotatable within the cylinder body, and wherein rotation of the cylinder within the cylinder body causes the latch mechanism to at least one of lockably engage and disengage with the latch catch of the storage compartment. The cylinder body may include an alignment feature configured to orientate the cylinder lock in a set position when installed in the opening of the one of the shoulder stock, butt, or handgrip. The cylinder lock may be installable and removable from the opening of the one of the shoulder stock, butt, or handgrip. The cylinder may be installable and removable from the opening of the one of the shoulder stock, butt, or handgrip. The latch mechanism may be further configured to be lockably engagable with a corresponding portion of a locking member, wherein the locking member extends from an endcap of the one of the shoulder stock, butt, or handgrip and towards the storage compartment when the endcap is installed thereon. The opening for receiving the cylinder lock may be formed in an endcap of the one of the shoulder stock, butt, or handgrip. The opening for receiving the cylinder lock may be formed in any one of a side, end, bottom, and top portion of the endcap of the one of the shoulder stock, butt, or handgrip. The latch catch for engaging with the latch mechanism may include a locking member extending from the storage compartment toward the endcap, wherein the locking member is configured to be engagable with the latch mechanism. The cylinder lock is configured such that when installed in the opening of the one of the shoulder stock, butt, or handgrip, and engaged in a locked position one or more components of the collapsible firearm stored within the storage compartment are not removable. The cylinder lock may be configured such that when installed in the opening of the one of the shoulder stock, butt, or handgrip, and engaged in a locked position an endcap of the one of the shoulder stock, butt, or handgrip is not removable, therefore locking in components of the collapsible firearm stored within the storage compartment. The endcap may be configured such that when locked in place the storage compartment comprises a locked container.

In still yet another embodiment, a collapsible firearm with an alternative locking mechanism is provided. The collapsible firearm with locking mechanism may include collapsible firearm; and a cylinder lock. The cylinder lock may include a cylinder body; and a cylinder, the cylinder may include a latch mechanism at a first end, wherein the cylinder is rotatable within the cylinder body; and wherein the cylinder lock is configured to be received in an opening formed in a portion of one of a shoulder stock, butt, or handgrip of the collapsible firearm, such that when installed the latch mechanism is lockably engagable with a corresponding latch catch, wherein the latch catch is formed in an interior portion of a storage compartment of the one of the shoulder stock, butt, or handgrip.

In still yet another embodiment, an alternative locking mechanism for a collapsible firearm is provided. The locking mechanism may include a locking member, including a first end and a second end, the first end including a stop, wherein the locking member is configured to be received by first and second channels formed through portions of an endcap and a storage compartment of one of a shoulder stock, butt, or handgrip of the collapsible firearm, and wherein the locking member is configured to pass through the first and second channels, such that a portion of the second end of the locking member protrudes from a portion of the one of the shoulder stock, butt, or handgrip opposite that of the first end of the locking member; and a securing mechanism configured to engage with the protruding portion of the second end of the locking member; and wherein the locking member is configured such that when installed through the first and second channels an endcap of the one of the shoulder stock, butt, or handgrip is not removable therefrom. The first channel may be provided from a first side to a second side of the storage compartment and the second channel may be provided from a first side to a second side of the endcap, and wherein the first and second channels are configured such that when the endcap is installed on the one of the shoulder stock, butt, or handgrip, the first channel substantially aligns with the second channel such that the locking member can be installed through the first and second channels, thereby locking the endcap to the storage compartment. The first channel may be provided from a top side to a bottom side of the storage compartment and the second channel may be provided from a top side to a bottom side of the endcap, and wherein the first and second channels are configured such that when the endcap is installed on the one of the shoulder stock, butt, or handgrip, the first channel substantially aligns with the second channel such that the locking member can be installed through the first and second channels thereby locking the endcap to the storage compartment. The second end of the locking member may include a through hole configured to engage with the securing mechanism. The securing mechanism may include any one of a lock, cable tie, or zip tie. The locking member may include any one of a rod, cable tie, or zip tie. The locking mechanism may further include a grommet provided at one or more openings of the first and second channels. The grommet may include a plastic, rubber, silicon, or composite material grommet. The grommet may include a waterproof or semi-waterproof grommet, and is configured to provide a waterproof or semi-waterproof seal at one or more openings of the first and second channels. The stop is preferably larger than the diameter of the first and second channels. The endcap is configured such that when the locking member is installed through the first and second channels and the securing mechanism is engaged the storage compartment is a locked container.

In still yet another embodiment, a collapsible firearm with an alternative locking mechanism is provided. The collapsible firearm with locking mechanism may include a collapsible firearm; and a locking member. The locking member may include a first end and a second end, the first end including a stop, wherein the locking member is configured to be received by first and second channels formed through portions of one of a shoulder stock, butt, or handgrip of the collapsible firearm, and wherein the locking member is configured to pass through the first and second channels, such that a portion of the second end of the locking member protrudes from a portion of the one of the shoulder stock, butt, or handgrip opposite that of the first end of the locking member; and a securing mechanism configured to engage with the protruding portion of the second end of the locking member; and wherein the locking member is configured such that when installed through the first and second channels an endcap of the one of the shoulder stock, butt, or handgrip is not removable, therefore locking components of the collapsible firearm within a storage compartment of the one of the shoulder stock, butt, or handgrip of the collapsible firearm.

BRIEF DESCRIPTION OF THE DRAWINGS

Figure 1:
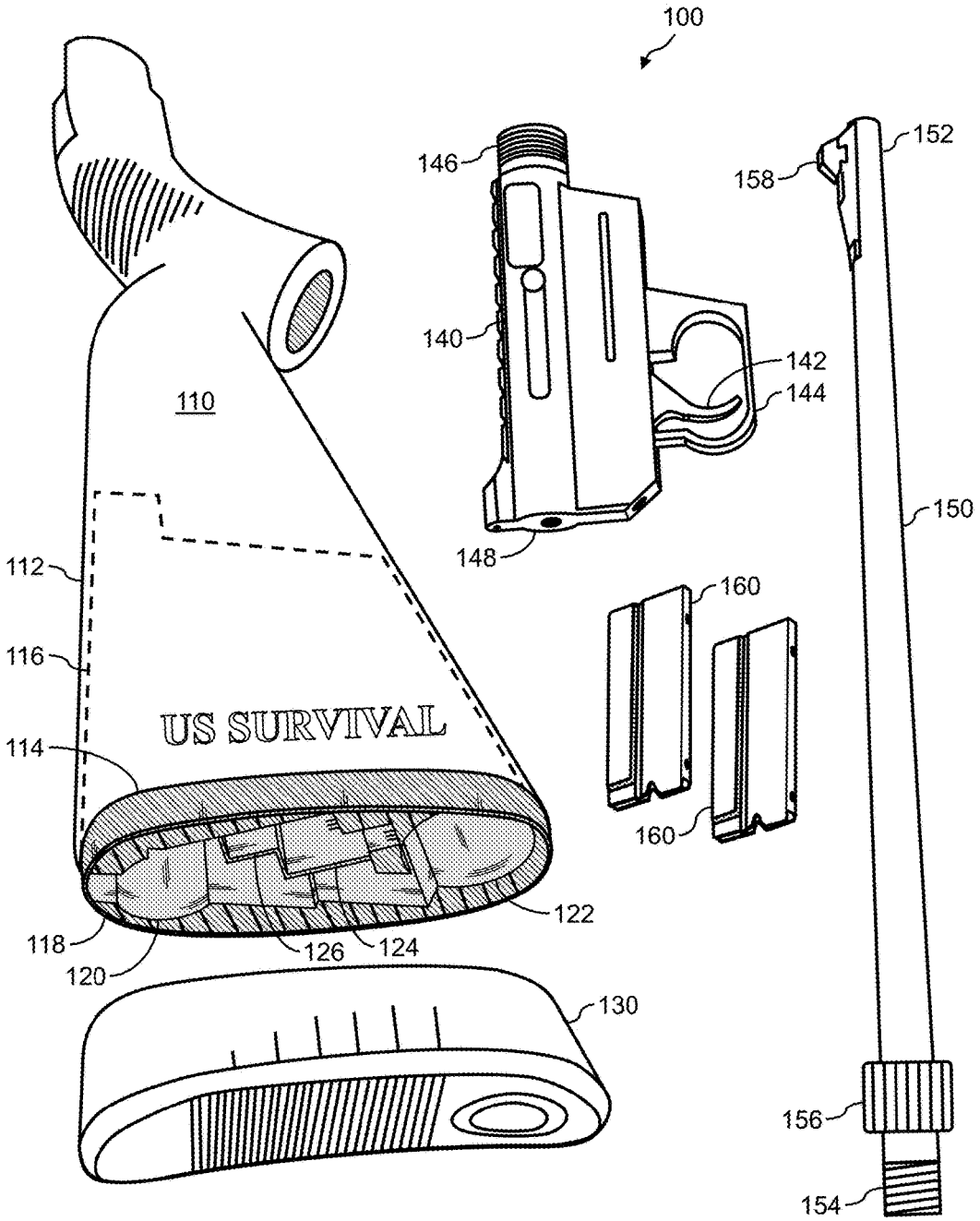
FIG. 1 (PRIOR ART)
Figure 2:
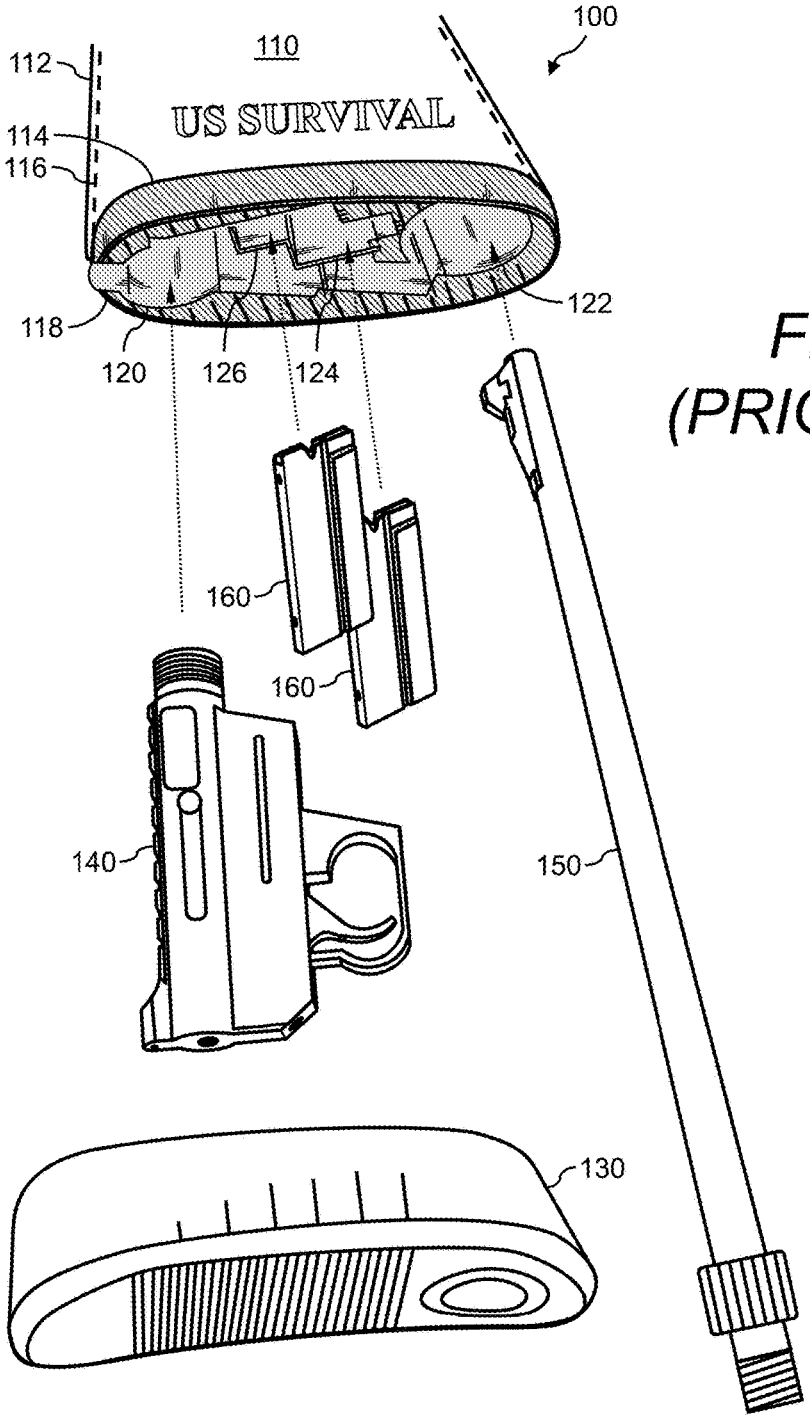
FIG. 2 (PRIOR ART)
Figure 3:
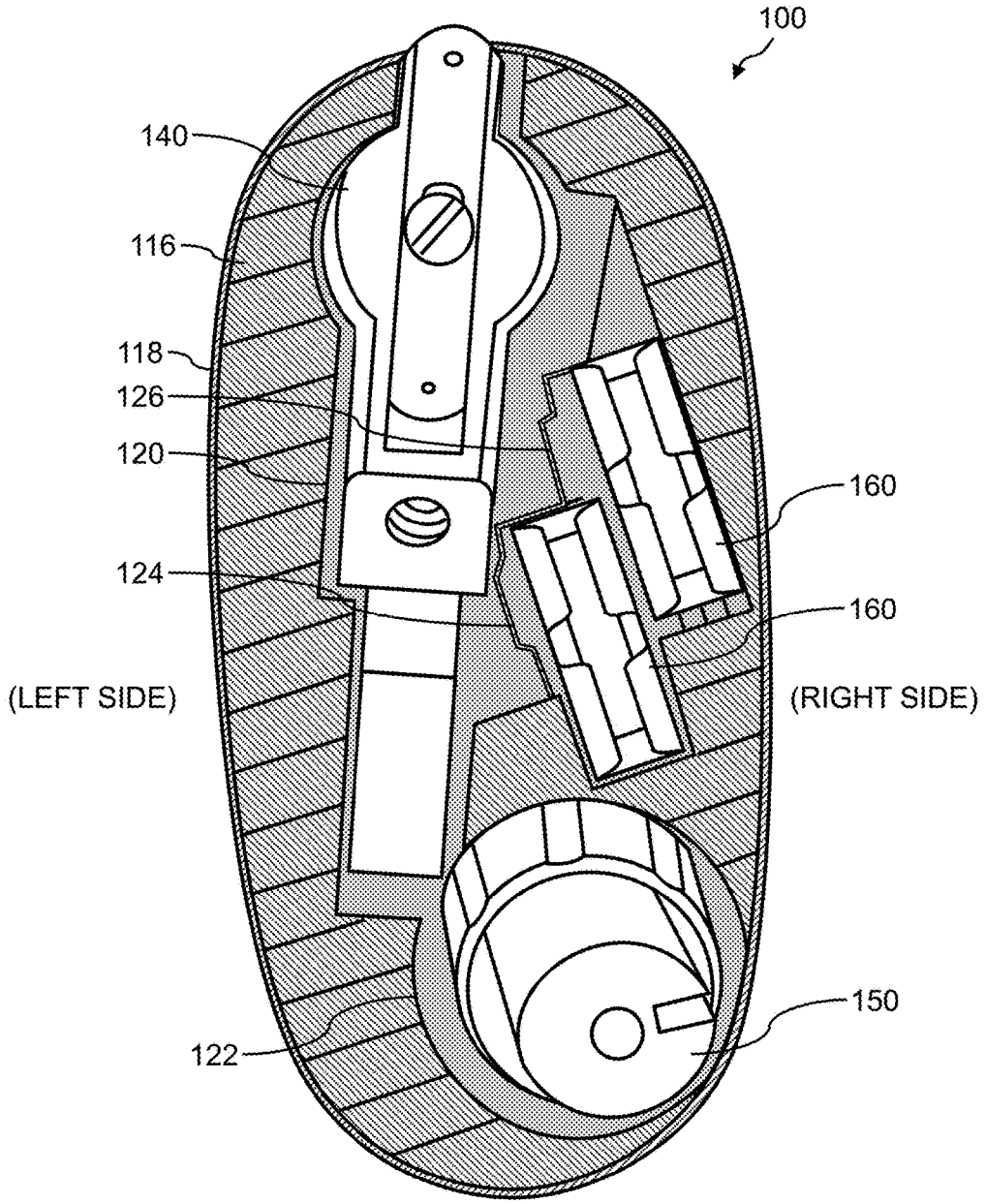
FIG. 3 (PRIOR ART)
Figure 4:
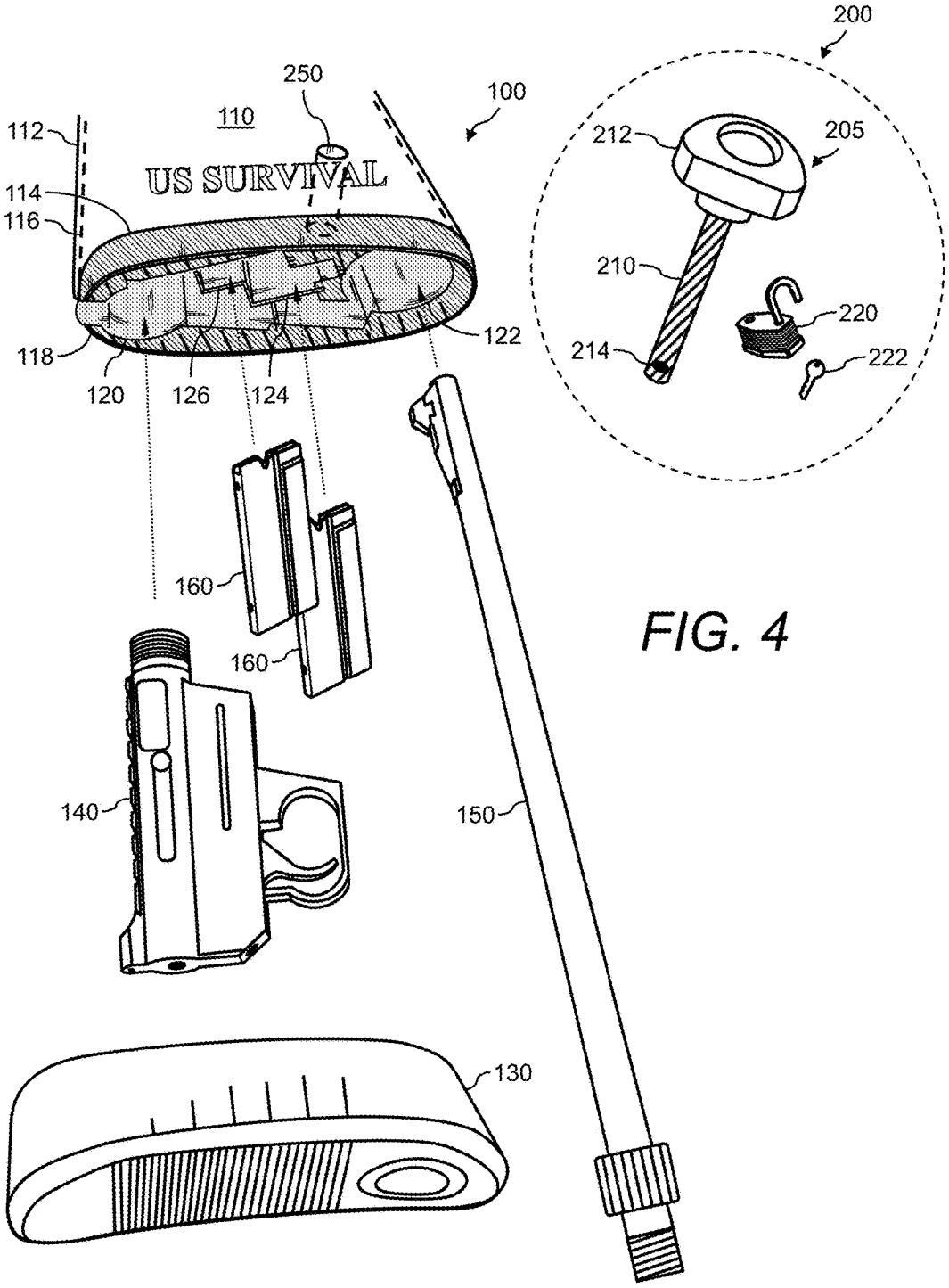
Figure 5:
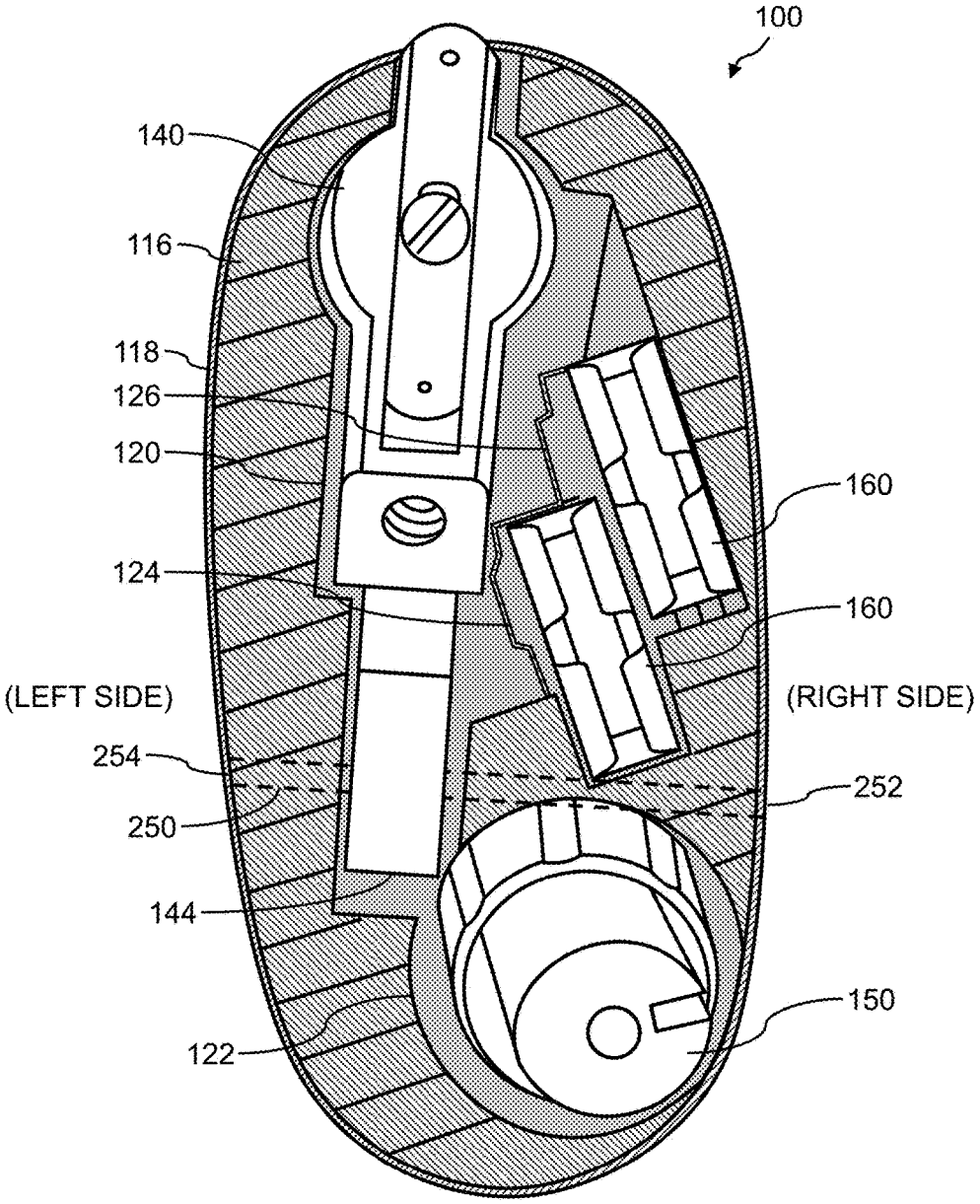
Figure 14:
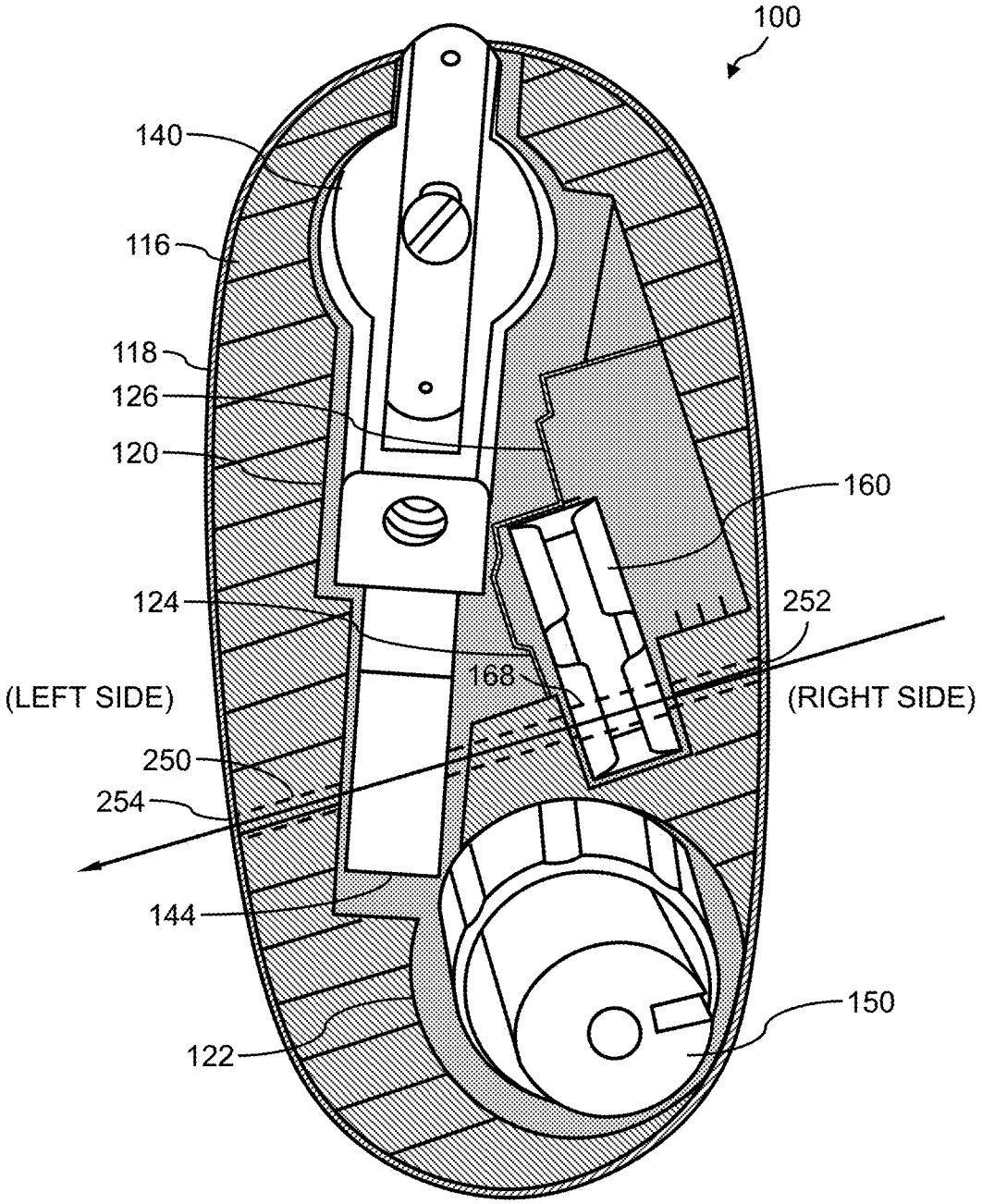
Figure 15:
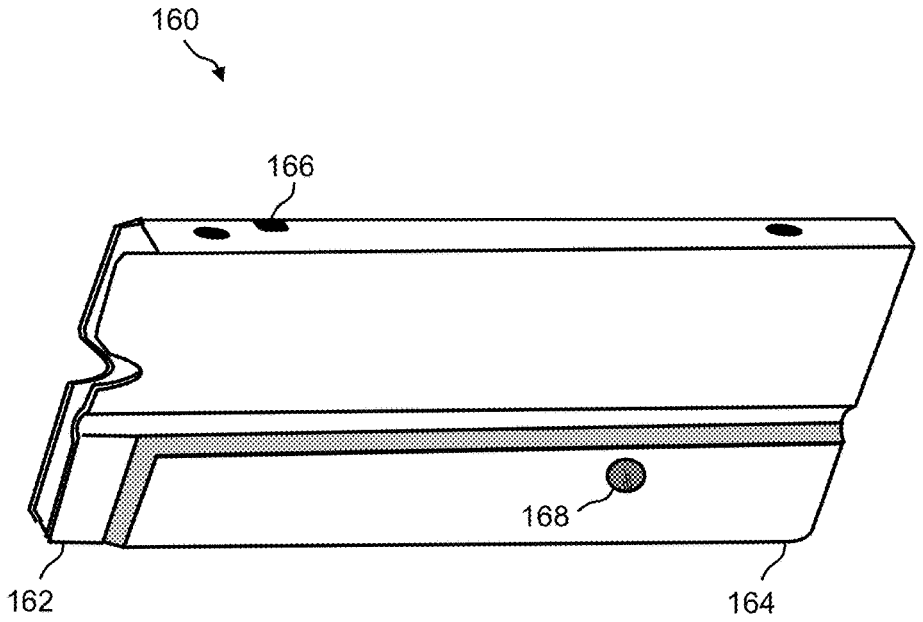
Figure 16:
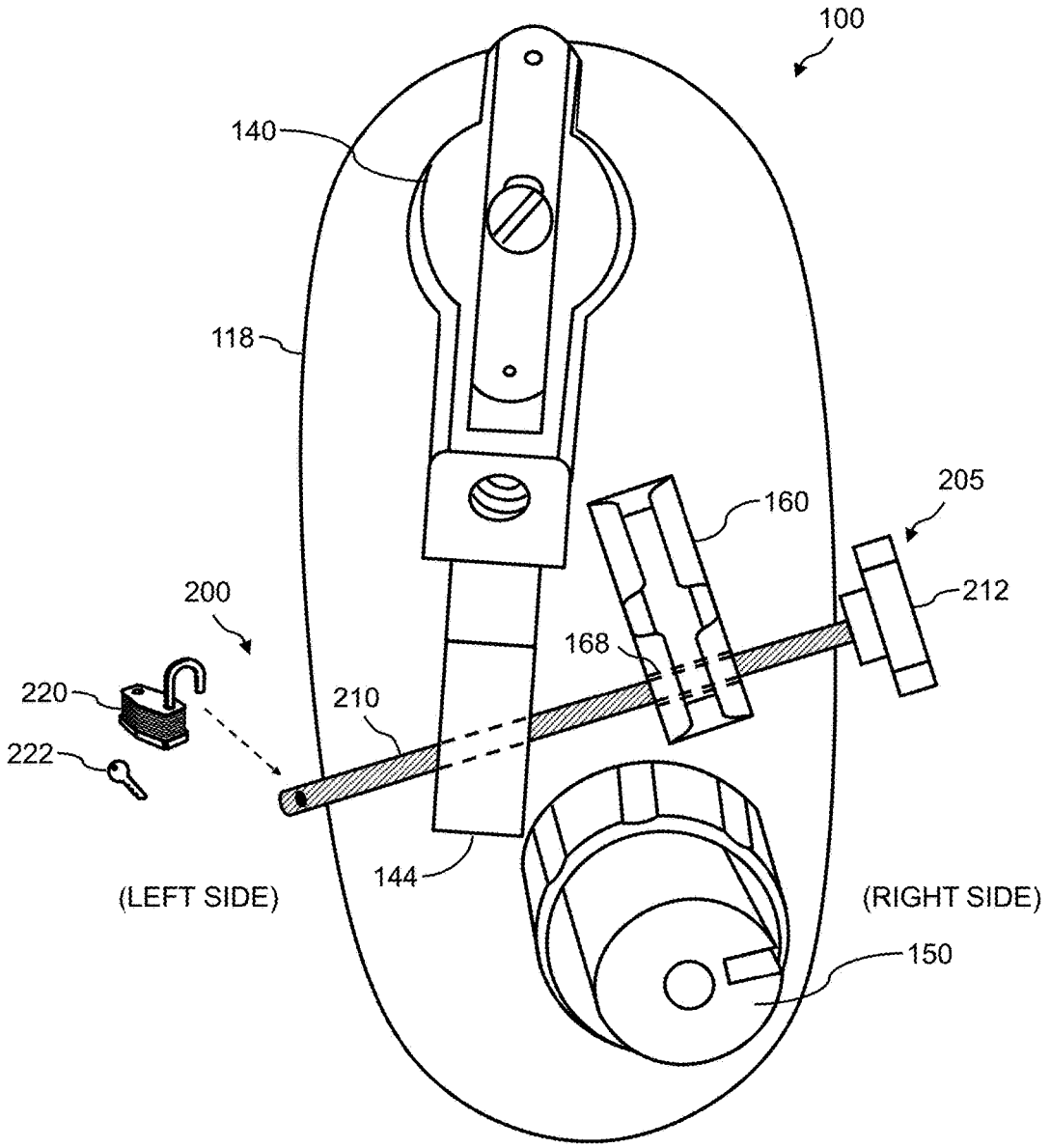
Figure 17:
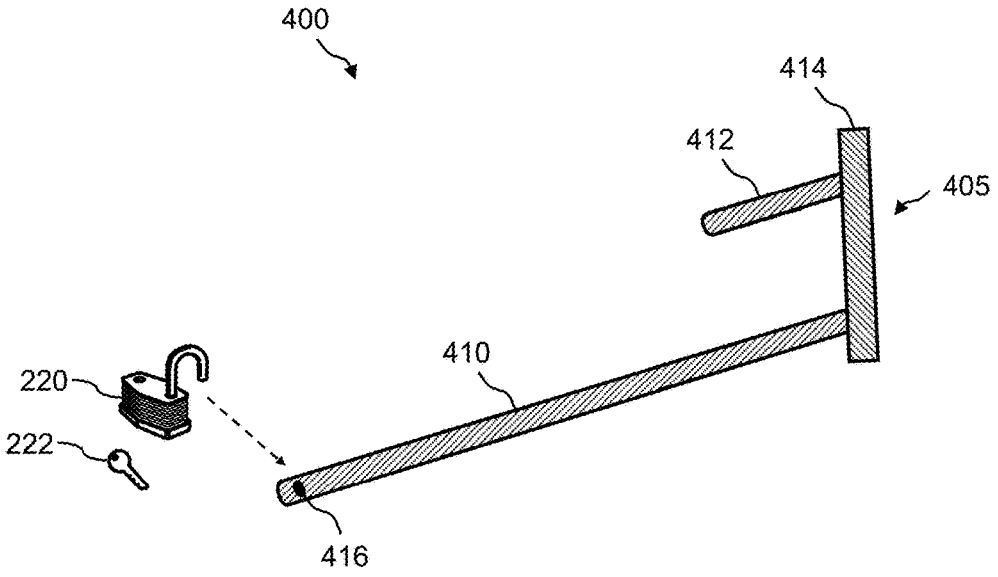
Figure 18:
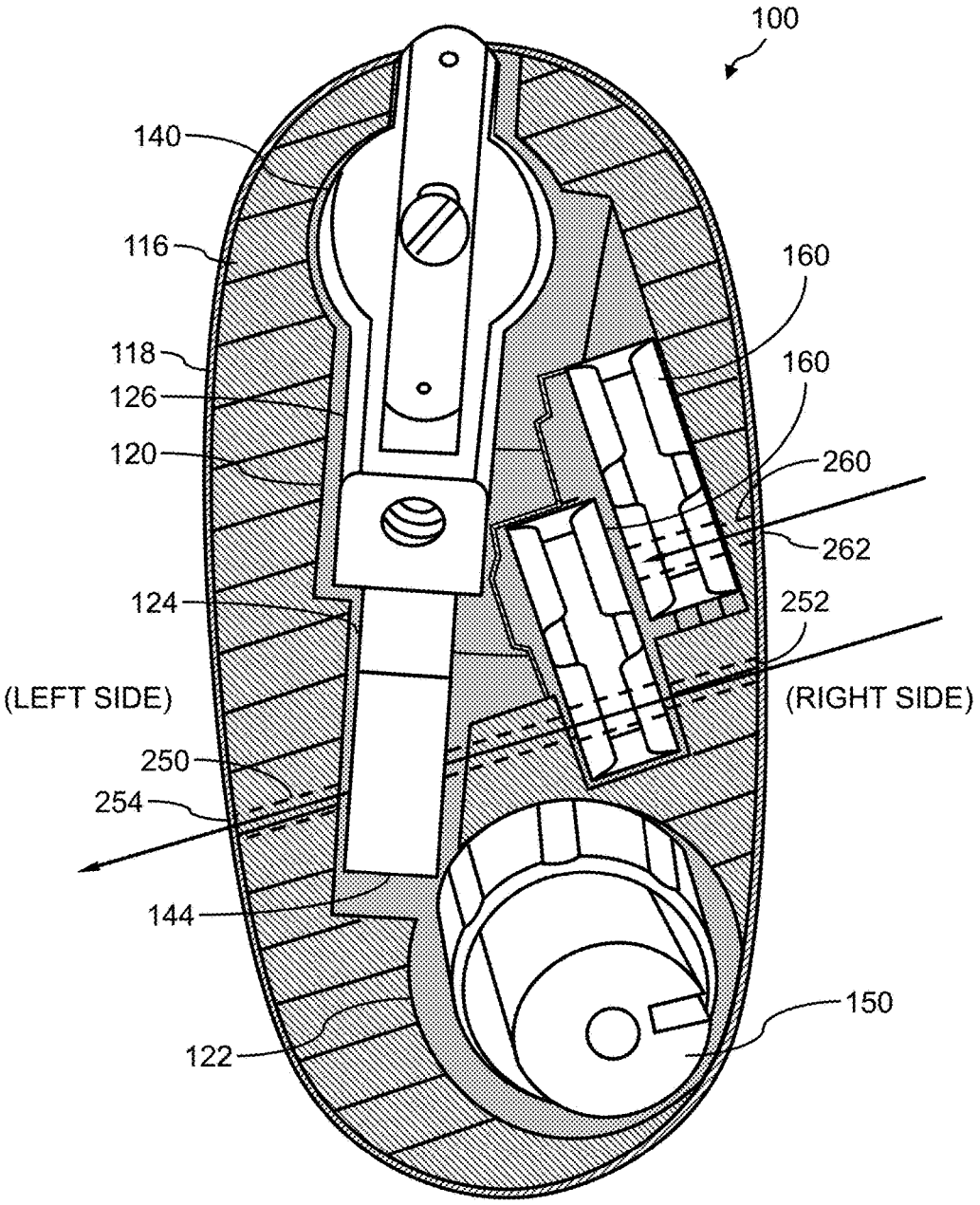
Figure 19:
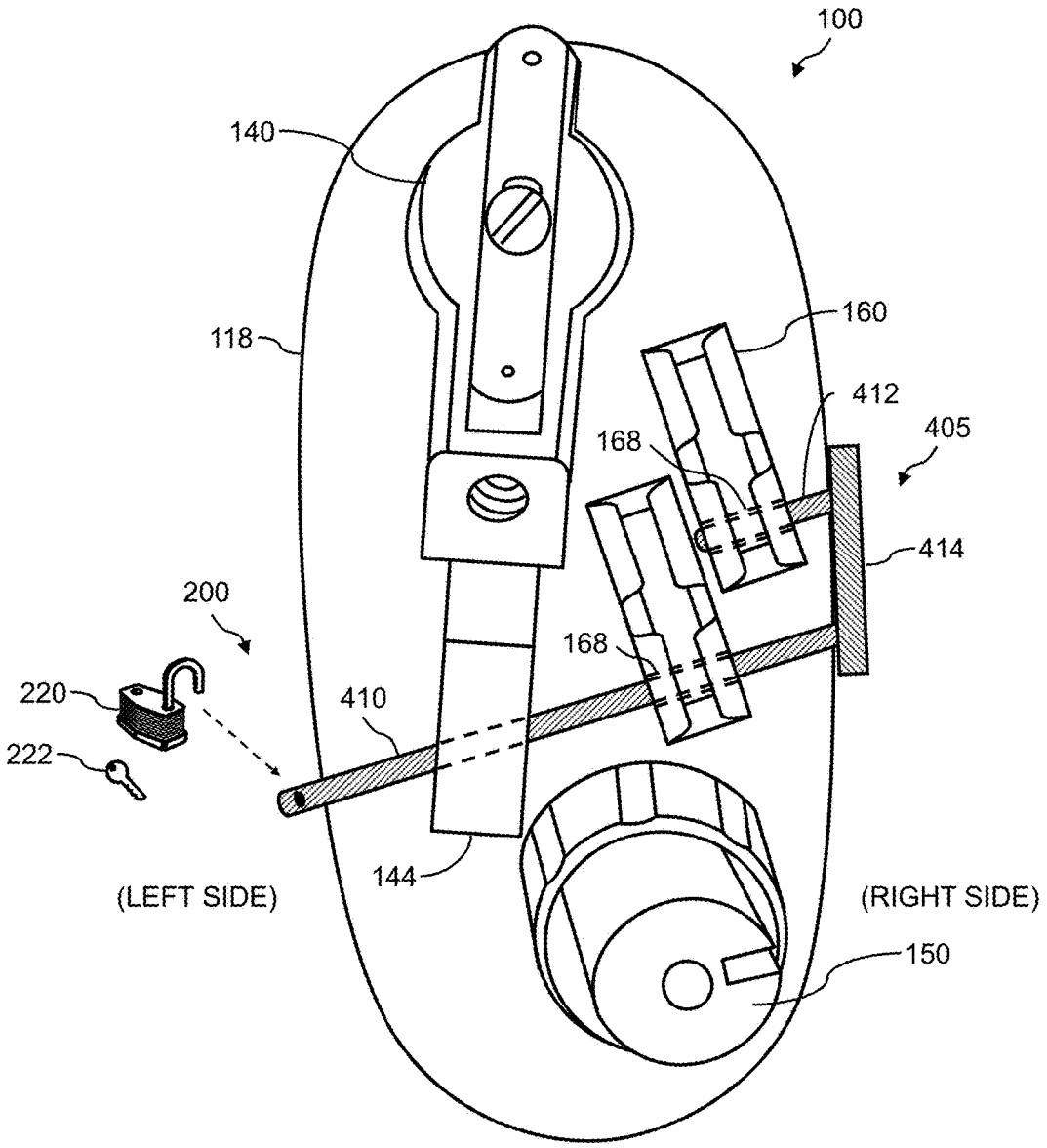
Figure 20:
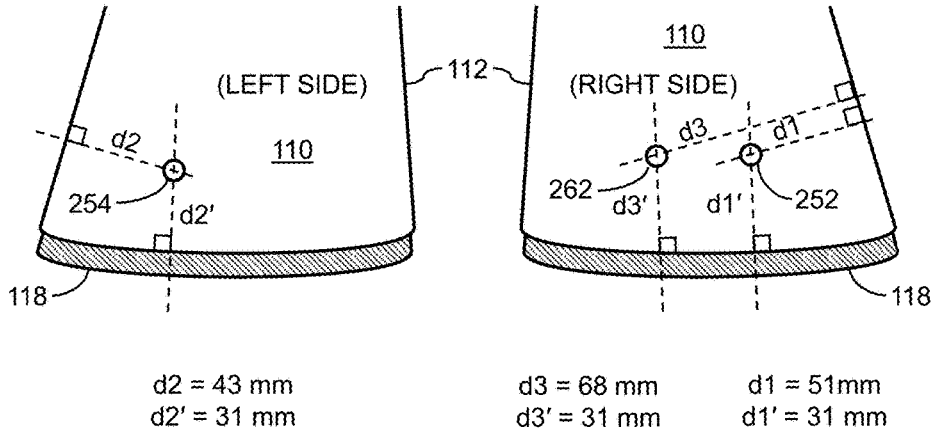
Figure 21:
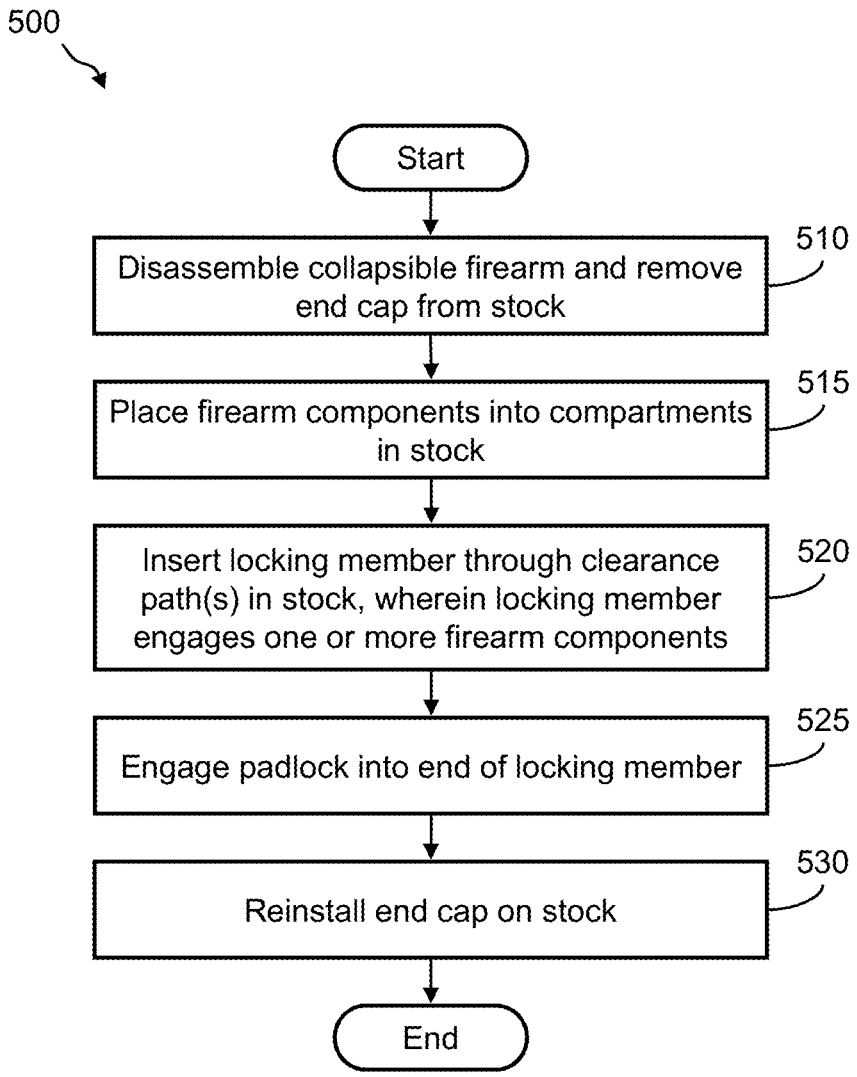
Figure 22:
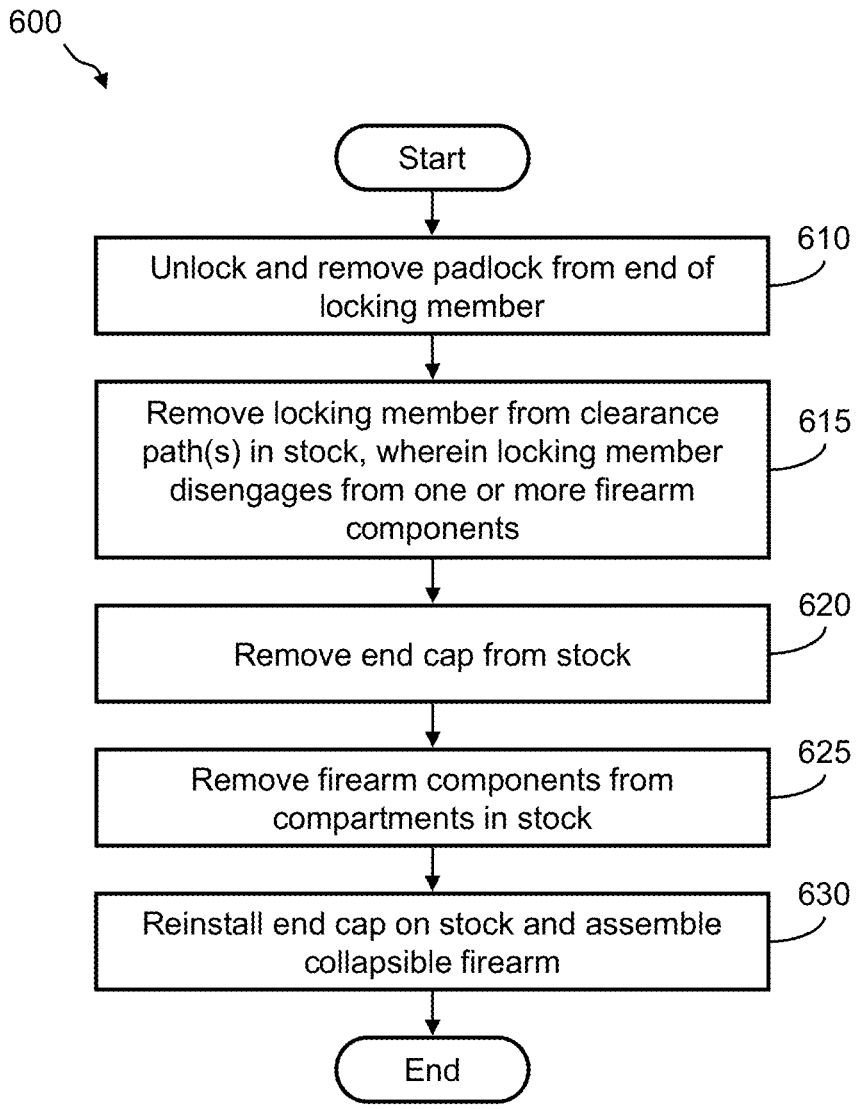
Figure 23:
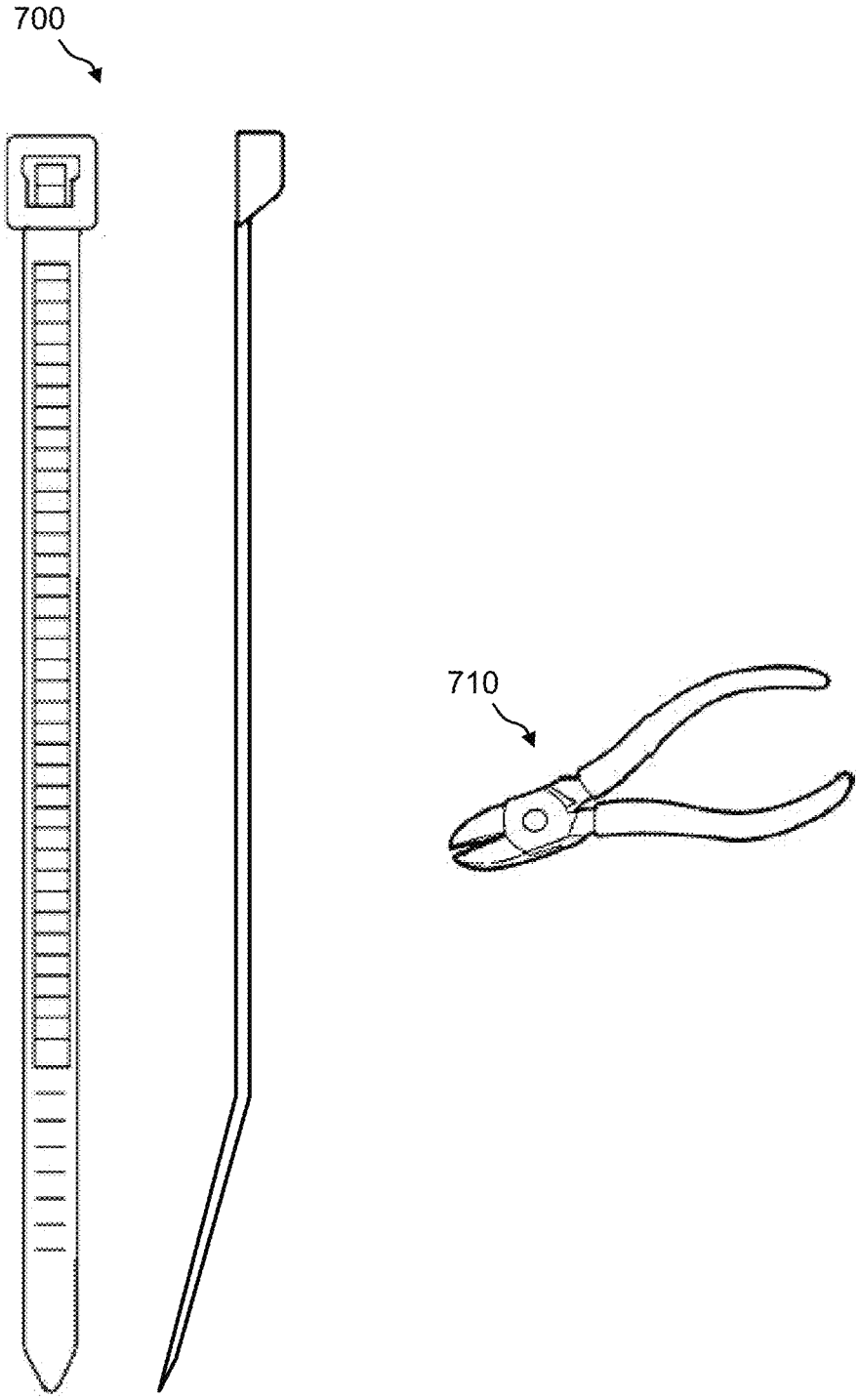
Figure 24:
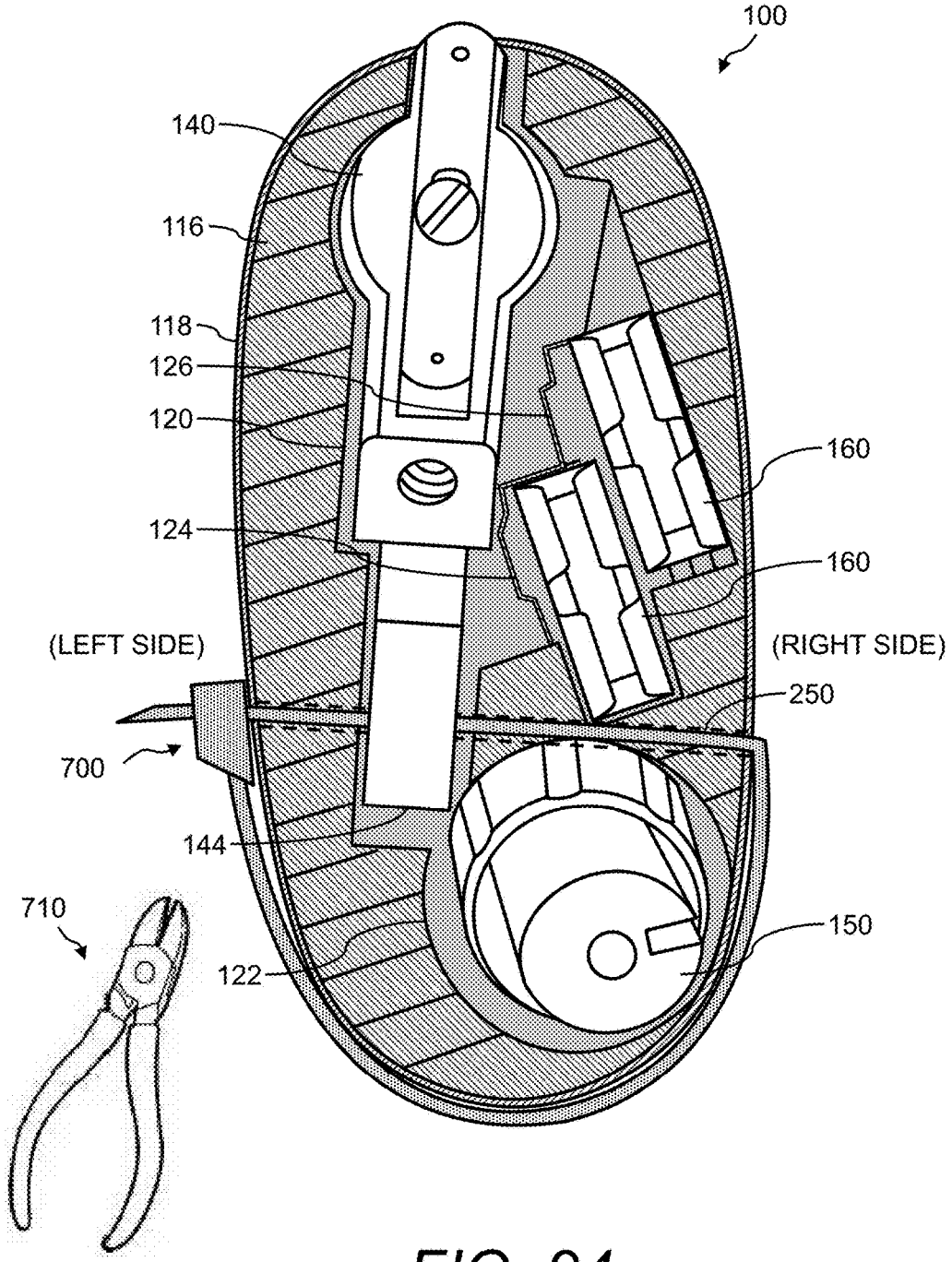
Figure 25:
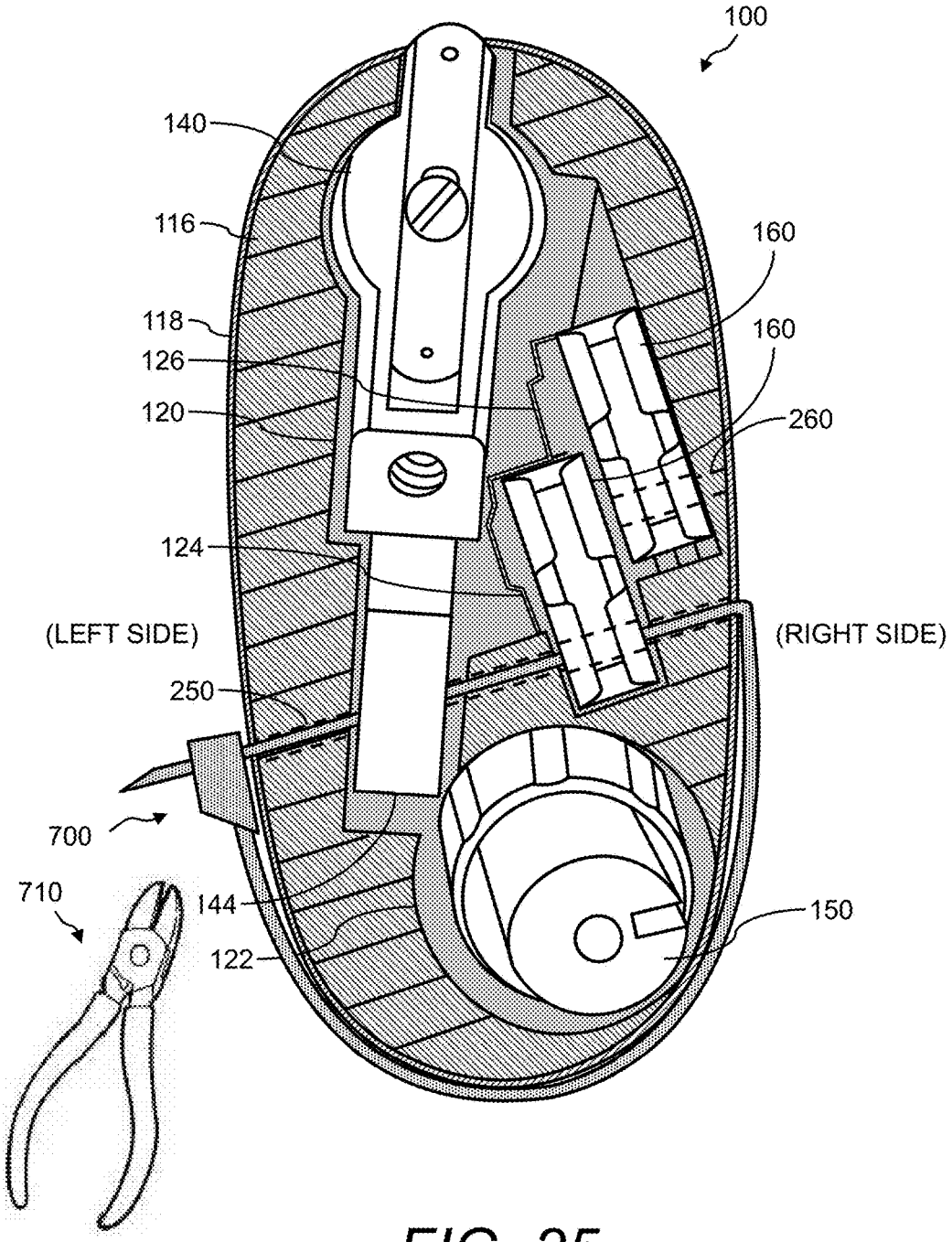
Figure 26:
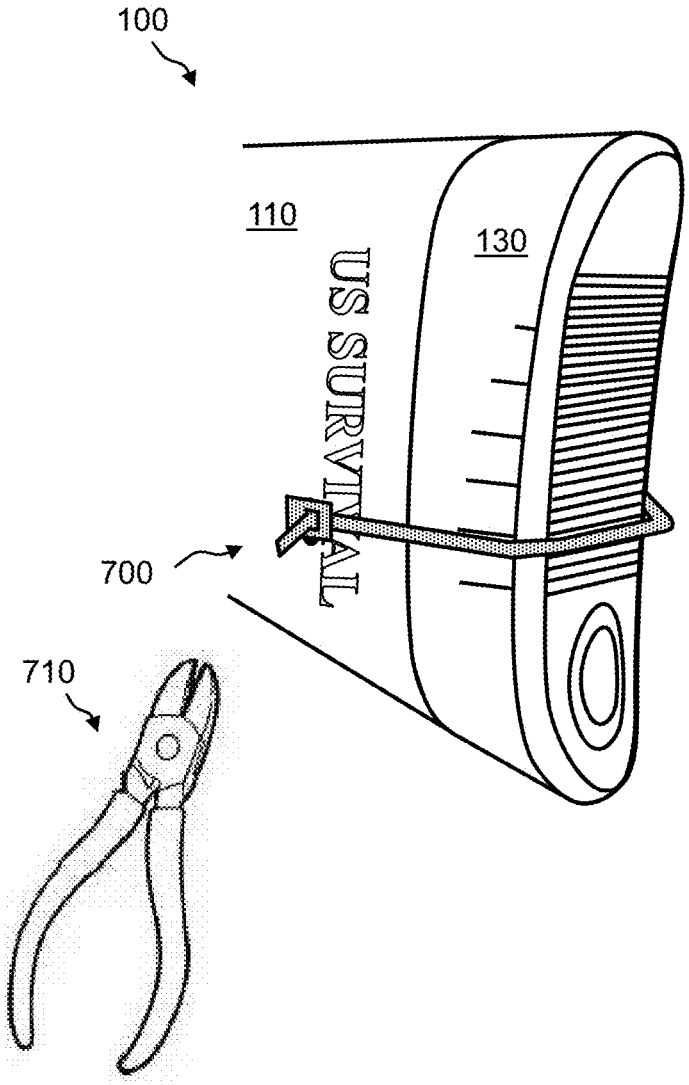
Figure 27A:
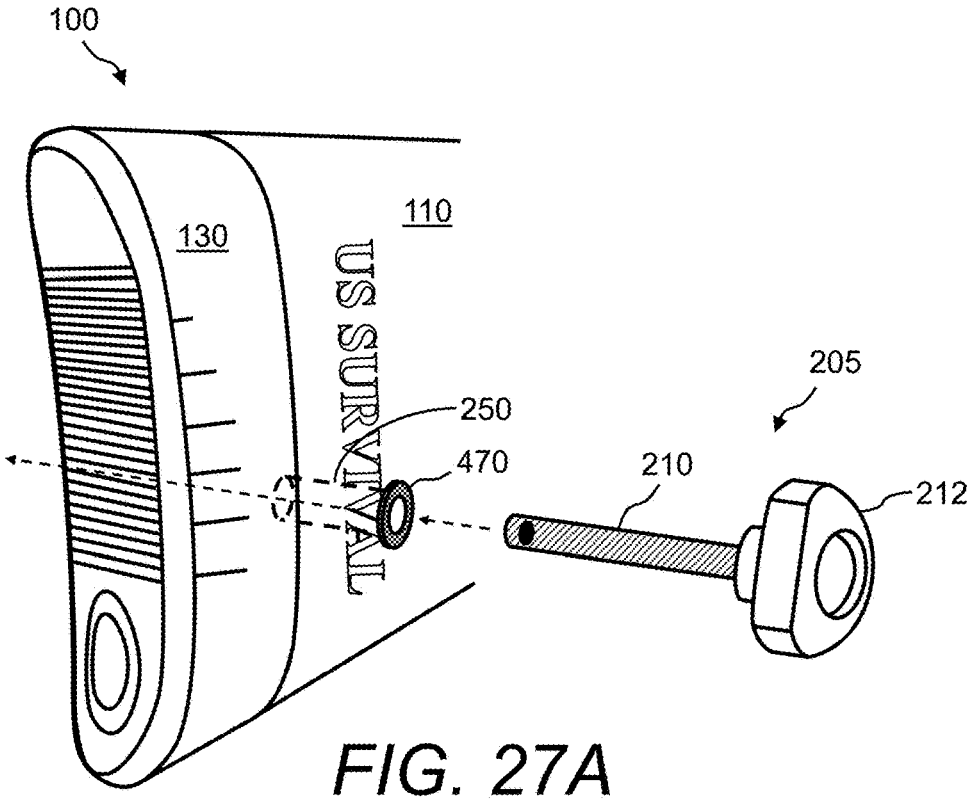
Figure 27B:
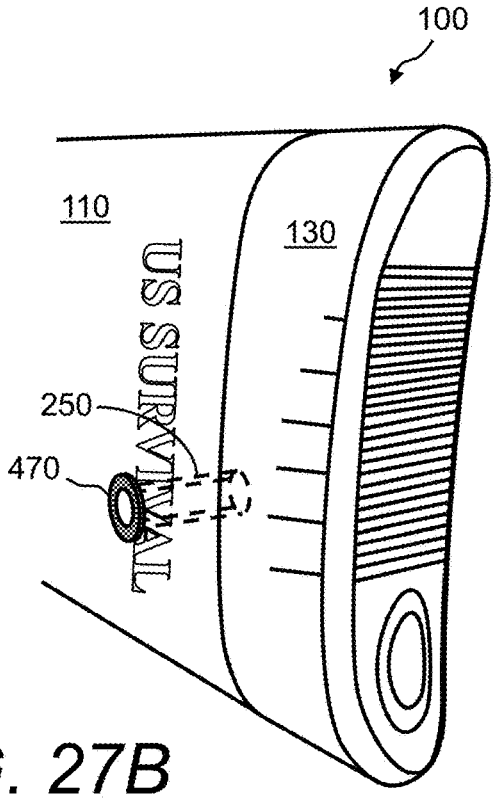
Figure 28A:
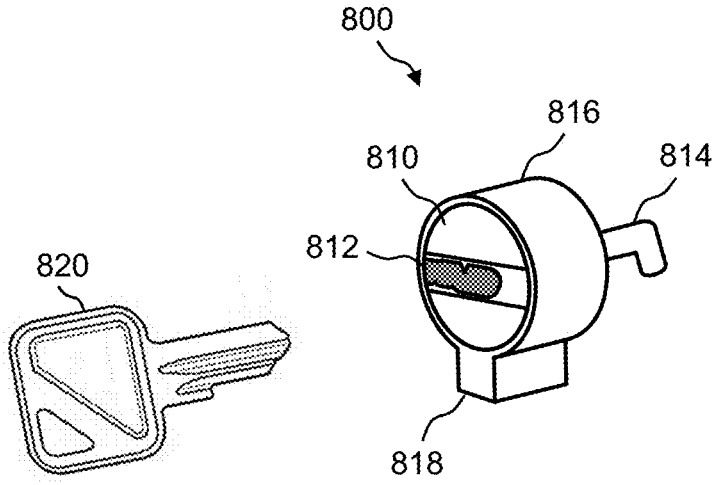
Figure 28B:
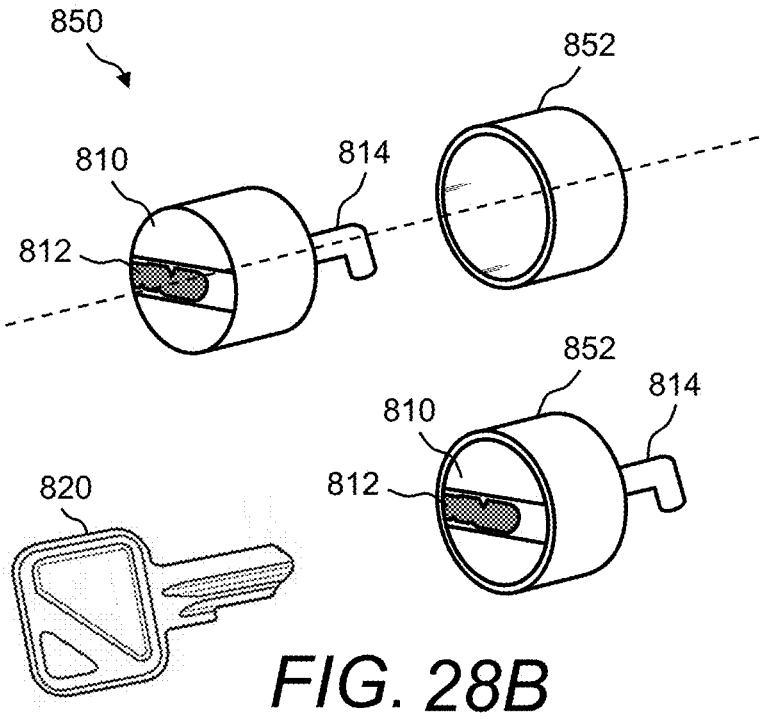

Having thus described the presently disclosed subject matter in general terms, reference will now be made to the accompanying Drawings, which are not necessarily drawn to scale, and wherein:

FIG. 1, FIG. 2, and FIG. 3 illustrate various views of an example of a conventional collapsible firearm in the disassembled state, wherein the conventional collapsible firearm is a Henry U.S. Survival AR-7 Rifle;

FIG. 4 illustrates a perspective view of a first example of the presently disclosed locking mechanisms that can be used with a conventional collapsible firearm that has been modified, such as the modified Henry U.S. Survival AR-7 Rifle;

FIG. 5 through FIG. 13 illustrate various views of an example of the Henry U.S. Survival AR-7 Rifle that is modified to receive the locking mechanism shown in FIG. 4;

FIG. 14, FIG. 15, and FIG. 16 illustrate various views of another example of the presently disclosed locking mechanisms that can be used with a conventional collapsible firearm that has been modified, such as the modified Henry U.S. Survival AR-7 Rifle;

FIG. 17, FIG. 18, and FIG. 19 illustrate various views of an example of a two-pronged locking mechanism that can be used with a conventional collapsible firearm that has been modified, such as the modified Henry U.S. Survival AR-7 Rifle;

FIG. 20 illustrates an example of the locations of the ends of the clearance channels shown in FIG. 14 through FIG. 19;

FIG. 21 illustrates a flow diagram of an example of a method of locking the components of a firearm using the presently disclosed locking mechanisms;

FIG. 22 illustrates a flow diagram of an example of a method of unlocking the components of a firearm using the presently disclosed locking mechanisms;

FIG. 23, FIG. 24, and FIG. 25 illustrate various views of still another example of the presently disclosed locking mechanisms that can be used with a conventional collapsible firearm that has been modified, such as the modified Henry U.S. Survival AR-7 Rifle;

FIG. 26 illustrates an example of the presently disclosed locking mechanism that can be used to perform an additional task of securing the endcap to the shoulder stock and thereby rendering the shoulder stock itself a locked container; and FIG. 27A and FIG. 27B illustrate perspective views of an example of a method of making the shoulder stock leak proof or at least leak resistant with the presently disclosed locking mechanism installed;

FIG. 28A and FIG. 28B illustrate various views of two examples of cylinder locks, which are yet other examples of the presently disclosed locking mechanisms that can be used with a conventional collapsible firearm that has been modified, such as the modified Henry U.S. Survival AR-7 Rifle;

FIG. 29A, FIG. 29B, FIG. 29C, and FIG. 29D illustrate various views of an example of the Henry U.S. Survival AR-7 Rifle that is modified to receive the cylinder lock shown in FIG. 28A and wherein the cylinder lock is a trigger lock;

FIG. 30A, FIG. 30B, FIG. 30C, FIG. 30D, and FIG. 30E illustrate various views of an example of the Henry U.S.

Figure 31:
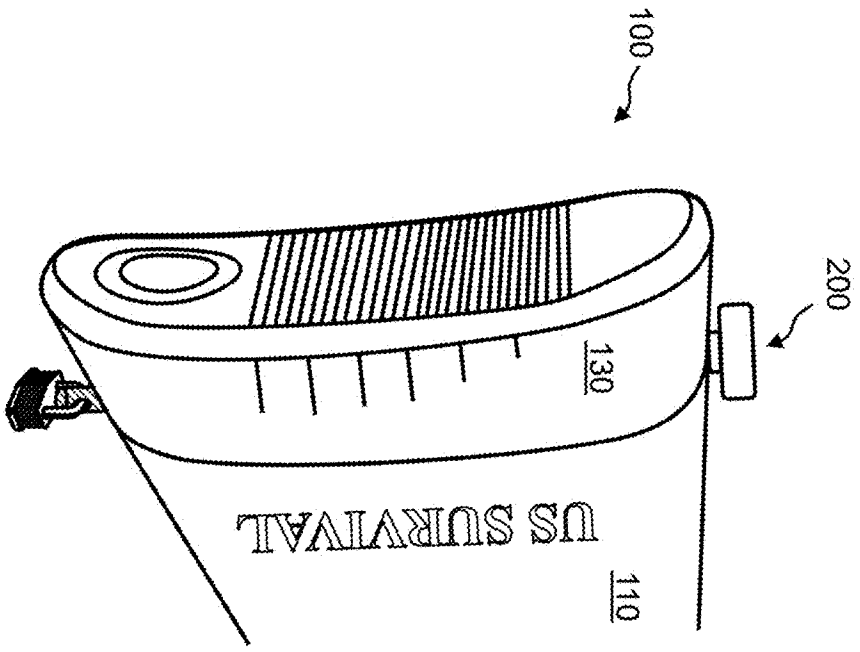
Figure 33A:
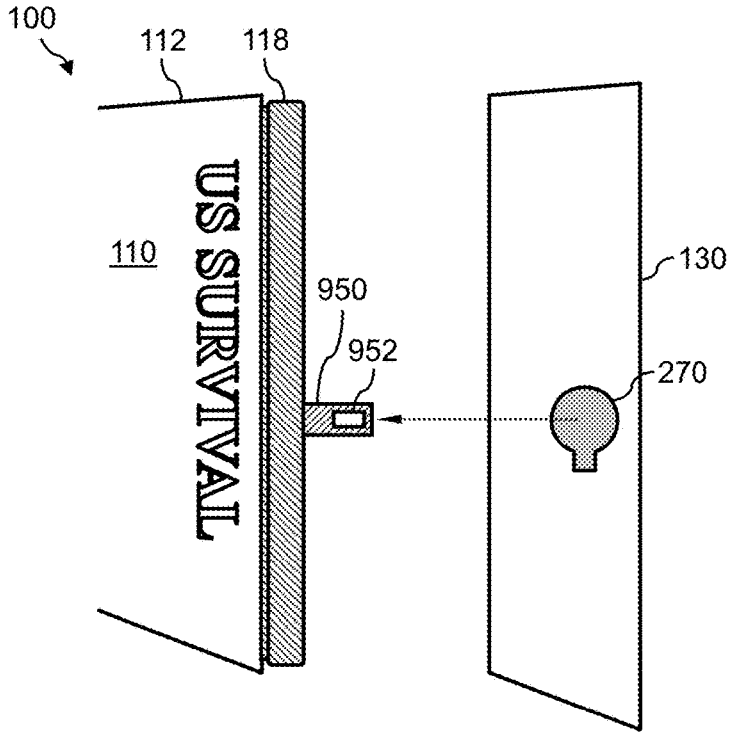
Figure 33B:
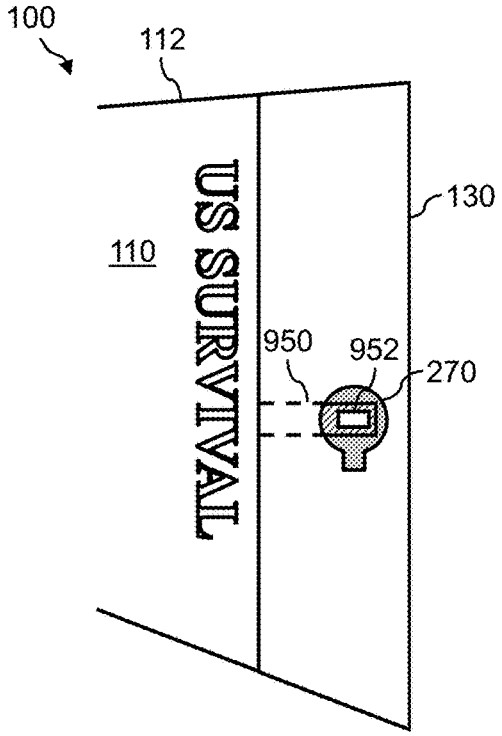
Figure 33C:
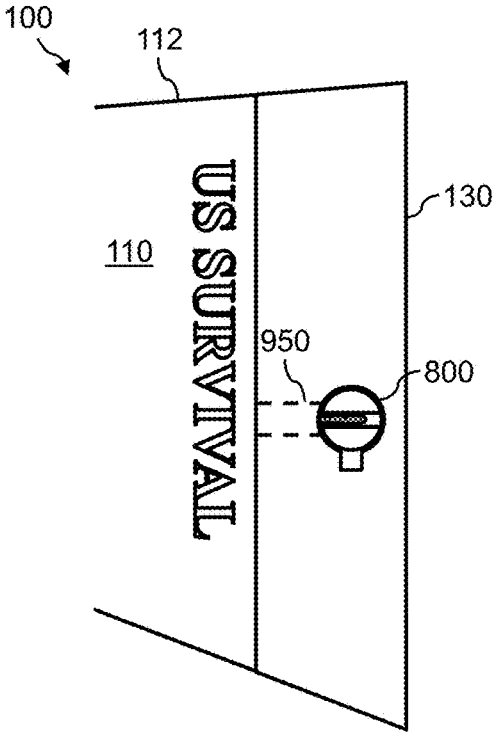
Figure 34A:
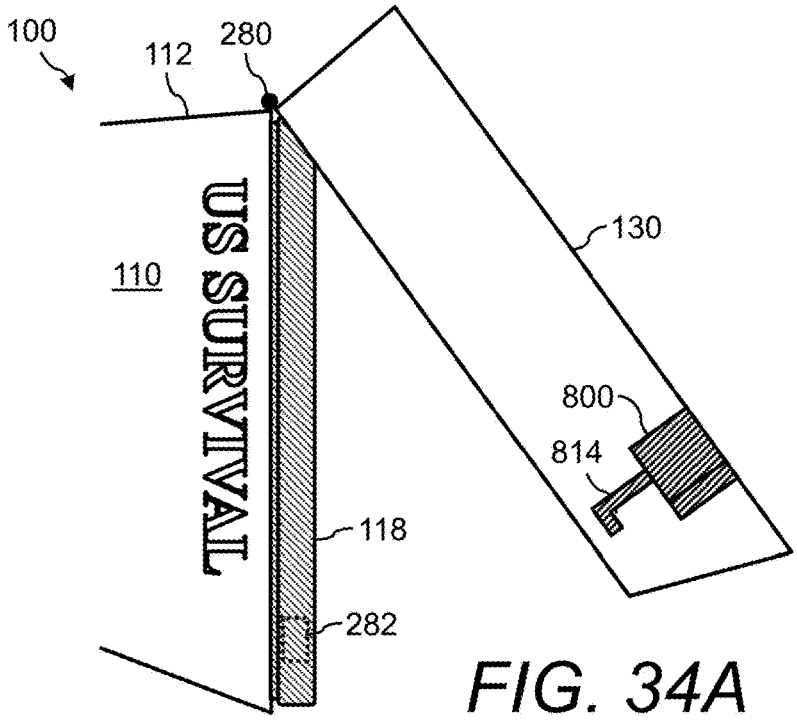
Figure 34B:
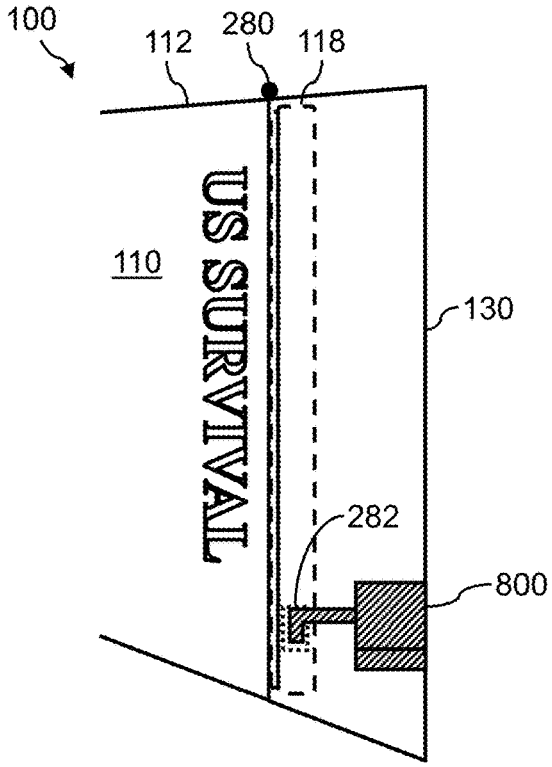
Figure 34C:
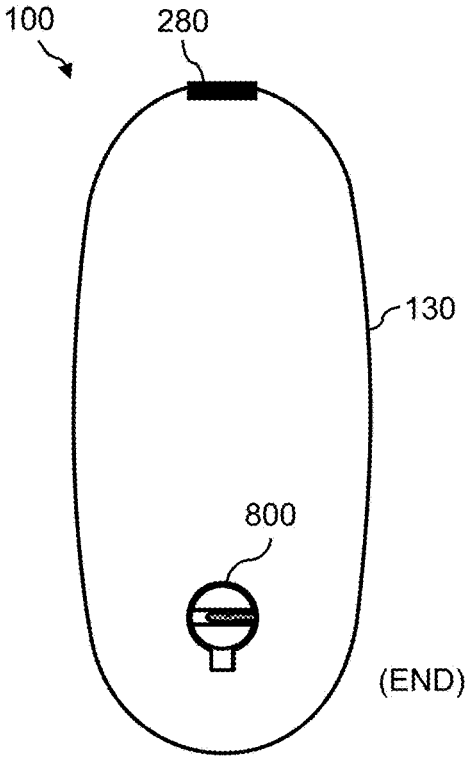
Figure 35A:
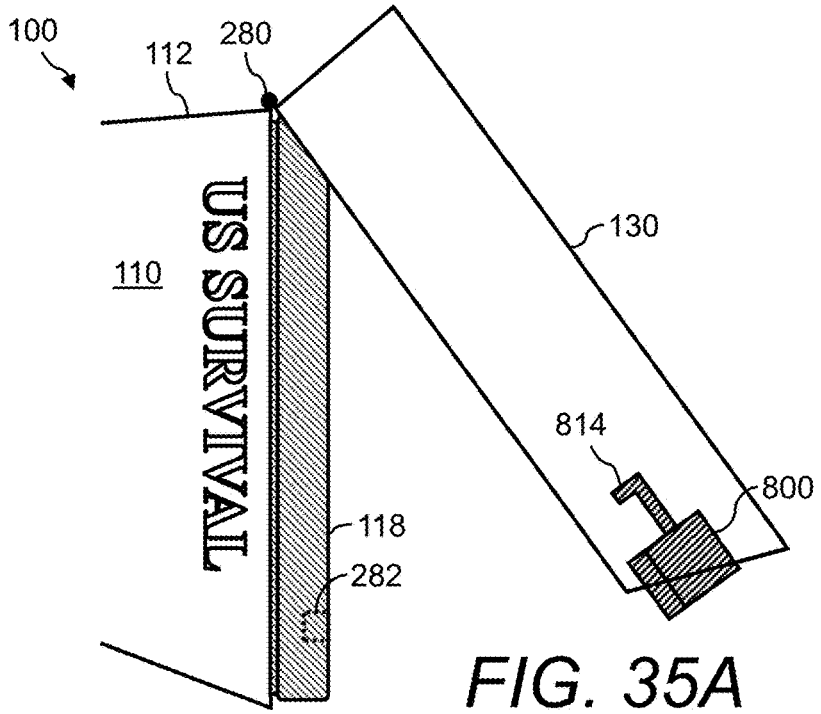
Figure 35B:
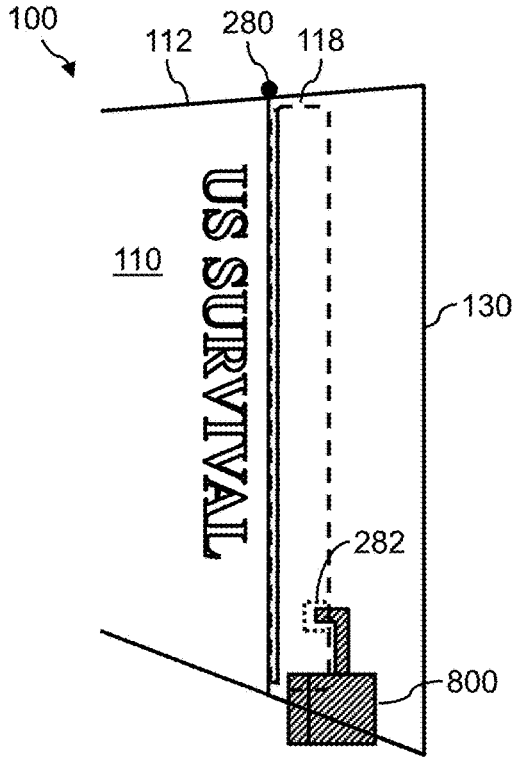
Figure 35C:
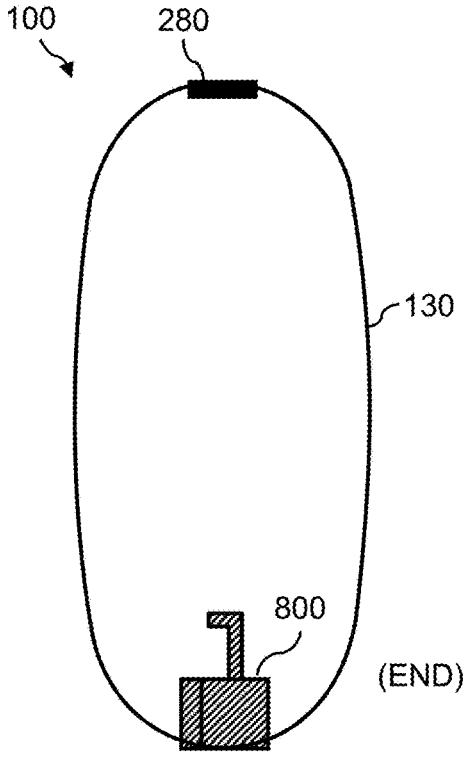

Survival AR-7 Rifle that is modified to lock the endcap thereof and thereby render the shoulder stock itself a locked container;

FIG. 31 illustrates a perspective view of another example of the Henry U.S. Survival AR-7 Rifle that is modified to lock the endcap thereof and thereby render the shoulder stock itself a locked container;

FIG. 32A, FIG. 32B, FIG. 32C, and FIG. 32D illustrate various views of yet another example of the Henry U.S. Survival AR-7 Rifle that is modified to lock the endcap thereof and thereby render the shoulder stock itself a locked container;

FIG. 33A, FIG. 33B, and FIG. 33C illustrate various views of yet another example of the Henry U.S. Survival AR-7 Rifle that is modified to lock the endcap thereof and thereby render the shoulder stock itself a locked container;

FIG. 34A, FIG. 34B, and FIG. 34C illustrate various views of yet another example of the Henry U.S. Survival AR-7 Rifle that is modified to lock the endcap thereof and thereby render the shoulder stock itself a locked container; and FIG. 35A, FIG. 35B, and FIG. 35C illustrate various views of still another example of the Henry U.S. Survival AR-7 Rifle that is modified to lock the endcap thereof and thereby render the shoulder stock itself a locked container.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides locking mechanisms for and methods of securing firearm components in the shoulder stock or butt and/or handgrip of a collapsible firearm. Herein "collapsible firearm" means any firearm that can be disassembled into multiple firearm components and whose shoulder stock or butt (in the case of rifles) and/or handgrip (in the case of pistols) doubles as both a carrying case for the firearm components as well as the shoulder stock or butt and/or handgrip. Examples of the firearm components that can be stowed in the shoulder stock or butt and/or handgrip of a collapsible firearm include, but are not limited to, the receiver, the barrel, and one or more magazines.

In some embodiments, the locking mechanism is a trigger locking mechanism, wherein the locking mechanism prevents the receiver from being removed from the shoulder stock or butt and/or handgrip of the collapsible firearm. In other embodiments, the locking mechanism is both a trigger locking mechanism and a magazine locking mechanism.

In the presently disclosed locking mechanisms, one or more clearance channels are provided through the shoulder stock or butt and/or handgrip of the collapsible firearm, wherein the paths of the one or more clearance channels pass through, for example, the trigger guard of the receiver and/or through through-holes in one or more magazines when the firearm components are stowed in the shoulder stock or butt and/or handgrip of the collapsible firearm.

The one or more clearance channels in the shoulder stock or butt and/or handgrip of the collapsible firearm are provided to receive one or more corresponding locking members (e.g., rigid bars or rods) of the presently disclosed locking mechanisms. By inserting the locking members through the clearance channels in the shoulder stock or butt and/or handgrip of the collapsible firearm, the locking members engage with, for example, the trigger guard of the receiver and/or the through-holes in the one or more magazines of the collapsible firearm. Once the one or more locking members is installed in the one or more clearance channels in the shoulder stock or butt and/or handgrip of the collapsible firearm, a padlock can be locked to the end of at least one of the locking members. In so doing, the receiver and/or the one or more magazines of the collapsible firearm are prevented from being removed from the shoulder stock or butt and/or handgrip of the collapsible firearm.

In other embodiments, the locking member can be a flexible zip tie (aka tie wrap or cable tie) that can pass through the clearance channel in the shoulder stock or butt and/or handgrip of the collapsible firearm and then its own locking mechanism engaged (in place of the padlock).

In yet other embodiments, a keyed cylinder lock is provided as the locking mechanism.

In still other embodiments, a locking mechanism is provided in the endcap of the collapsible firearm, thereby rendering the shoulder stock itself a locked container and wherein the shoulder stock may meet federal, state, and/or local regulations with respect to locked containers for firearms.

FIG. 1, FIG. 2, and FIG. 3 show various views of an example of a conventional collapsible firearm 100 in the disassembled state. By way of example, the conventional collapsible firearm 100 shown in FIG. 1, FIG. 2, and FIG. 3 is the Henry U.S. Survival AR-7 Rifle available from Henry Repeating Arms (Bayonne, N.J.). However, the presently disclosed locking mechanisms disclosed herein are not limited to use with the Henry U.S. Survival AR-7 Rifle only. The Henry U.S. Survival AR-7 Rifle is exemplary only. The presently disclosed locking mechanisms can be used with any type or brand of collapsible firearm in which the components of the collapsible firearm can be stored in the shoulder stock or butt and/or handgrip thereof. Another example of a conventional collapsible firearm is the Mauser C96, which is a semi-automatic pistol that was originally produced by German arms manufacturer Mauser.

In this example, the conventional collapsible firearm 100 (e.g., the Henry U.S. Survival AR-7 Rifle) includes a plurality of components that can be assembled for use as a firearm and then disassembled for storage or for carrying. For example, the conventional collapsible firearm 100 includes a shoulder stock 110 that has an endcap 130, a receiver 140, a barrel 150, and one or two magazines 160.

The receiver 140 has a trigger 142 that is surrounded by a trigger guard 144, a forward end 146 that is threaded, and a rear end 148.

The barrel 150 has a forward end 152, a rear end 154 that is threaded, a threaded collar 156 around the rear end 154, and a site 158 mounted at the forward end 152 of the barrel 150. The rear end 154 of the barrel 150 can be threaded into the forward end 146 of the receiver 140. Then, the threaded collar 156 of the barrel 150 is threaded onto the forward end 146 of the receiver 140. Then, the rear end 148 of the receiver 140 can be secured to the forward end of the shoulder stock 110. When in use, one of the magazines 160 can be loaded with ammunition and then engaged into the receiver 140 by conventional means.

The shoulder stock 110 has a butt end outer shell 112 with an opening 114. The main body of the shoulder stock 110, including the butt end outer shell 112, can be formed, for example, of molded plastic or metal.

A storage compartment 116 may be provided in the butt end outer shell 112, wherein the storage compartment 116 is shaped to substantially correspond to the shape of the butt end outer shell 112. An edge portion 118 of the storage compartment 116 protrudes from the opening 114 of the butt end outer shell 112. The edge portion 118 of the storage compartment 116 is designed to receive the endcap 130. Namely, the endcap 130 can be press-fitted onto the edge portion 118 of the storage compartment 116, wherein the forward edge of the endcap 130 stops against the opening 114 of the butt end outer shell 112 of the shoulder stock 110.

The storage compartment 116 may be any of a removable or affixed insert piece or pre-formed space integrally formed within the shoulder stock 110, to provide one or more container compartments, and may be formed, for example, of molded plastic, metal, wood, and/or any other suitable material and/or process. The storage compartment 116 includes multiple compartments for holding the various components of the conventional collapsible firearm 100. For example, the storage compartment 116 includes a compartment 120 for holding the receiver 140, a compartment 122 for holding the barrel 150, a compartment 124 for holding one of the magazines 160, and a compartment 126 for holding one of the magazines 160.

FIG. 1 shows a perspective view of the conventional collapsible firearm 100 with the endcap 130, the receiver 140, the barrel 150, and the one or two magazines 160 laid out separate from the shoulder stock 110 that has the storage compartment 116. FIG. 2 shows a perspective view of the conventional collapsible firearm 100 with the endcap 130, the receiver 140, the barrel 150, and the one or two magazines 160 aligned with their corresponding compartments in the storage compartment 116 and ready to be inserted into the shoulder stock 110. Namely, the forward end 146 of the receiver 140 is oriented toward the compartment 120, the forward end 152 of the barrel 150 is oriented toward the compartment 122, one end of one magazine 160 is oriented toward the compartment 124, and one end of the other magazine 160 is oriented toward the compartment 126. FIG. 3 shows an end view of the conventional collapsible firearm 100 (absent the endcap 130) and with the receiver 140, the barrel 150, and the two magazines 160 installed in the storage compartment 116 of the shoulder stock 110.

According to the presently disclosed subject matter, locking mechanisms are provided that can be applied to the conventional collapsible firearm 100 (e.g., the Henry U.S. Survival AR-7 Rifle) via simple modifications to the conventional collapsible firearm 100, more details of which are shown and described hereinbelow with reference to FIG. 4 through FIG. 23.

Referring now to FIG. 4 is a perspective view of a locking mechanism 200, which is a first example of the presently disclosed locking mechanisms. The locking mechanism 200 can be used in combination with, for example, the conventional collapsible firearm 100 (e.g., the Henry U.S. Survival AR-7 Rifle) shown in FIG. 1, FIG. 2, and FIG. 3, wherein the conventional collapsible firearm 100 has been modified to receive the locking mechanism 200. The two locking mechanism 200 is an example of a trigger locking mechanism for a conventional collapsible firearm.

In this example, the locking mechanism 200 includes a locking member 205 and a padlock 220, wherein the padlock 220 has a key 222. However, in other embodiments, the padlock 220 can be a combination lock instead of a keyed lock. The locking member 205 includes a rigid bar 210. A knob 212 is provided at one end of the rigid bar 210. The knob 212 can be any type or shape of knob, handle, plate, cap, or grasping device, as long as the knob 212 is larger than the diameter of clearance channel 250 such that it provides a stop against the shoulder stock 110. The knob 212 is attached to the rigid bar 210 in a substantially permanent fashion such that it cannot be easily separated from the end of the rigid bar 210. A through-hole 214 is provided at the opposite end of the rigid bar 210. The through-hole 214 at the end of the rigid bar 210 is sized to receive the hasp of the padlock 220.

Figure 6:
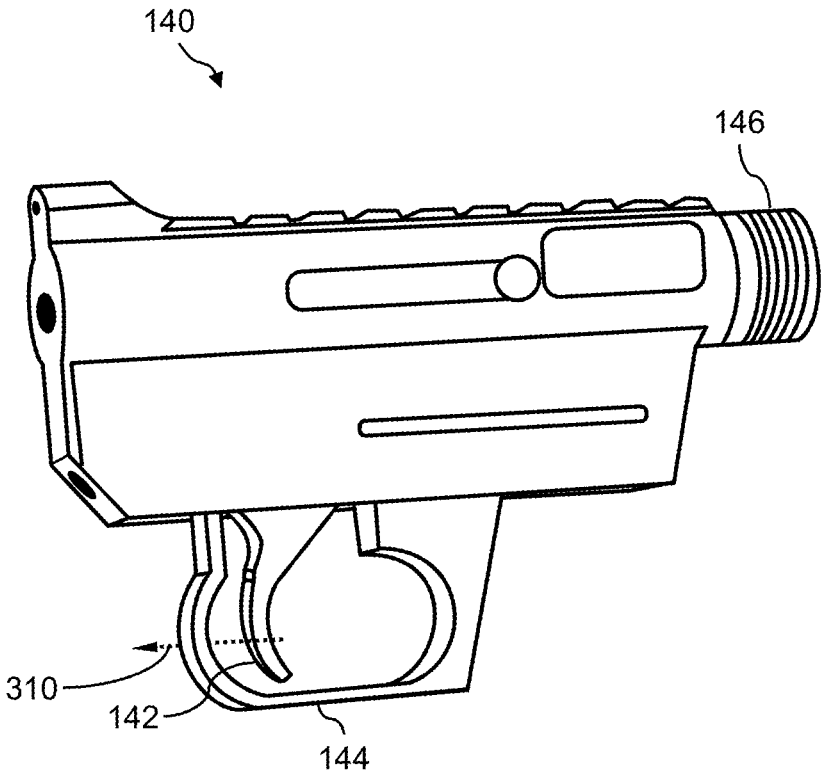

The conventional collapsible firearm 100 (e.g., the Henry U.S. Survival AR-7 Rifle) is modified to receive the locking member 205 such that the rigid bar 210 of the locking member 205 engages the receiver 140 and prevents the receiver 140 from being removed from the storage compartment 116 of the shoulder stock 110. For example and referring now to FIG. 5 (an end view), a clearance channel 250 can be drilled, bored, or otherwise formed from one side of the shoulder stock 110 and storage compartment 116 to the other. Alternatively, the clearance channel 250 can be formed during manufacture of the conventional collapsible firearm 100. In one example, the clearance channel 250 has a right side opening 252 and a left side opening 254. The clearance channel 250 can take any line-of-sight path from one side of the shoulder stock 110 to the other, as long as the clearance channel 250 passes through the trigger guard 144 of the receiver 140 and, namely, between the trigger guard 144 and the back side of the trigger 142. For example, FIG. 6 shows the receiver 140 and a path 310 that represents an example of the path that the clearance channel 250 can take between the trigger guard 144 and the back side of the trigger 142.

Figure 7:
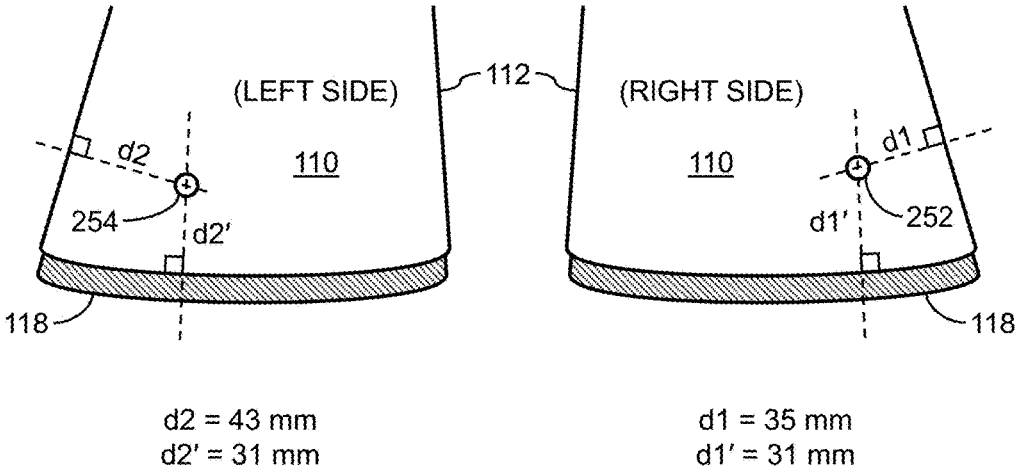

The clearance channel 250 can take any line-of-sight path (at any angle) from one side of the shoulder stock 110 to the other as long as it passes through the trigger guard 144 and behind the trigger 142 of the receiver 140. Referring now to FIG. 7 (right and left side views) is an example of the locations of the ends of the clearance channel 250. For example, the location of the right side opening 252 of the clearance channel 250 on the right side of the shoulder stock 110 is a distance d1 as measured at a right angle from the bottom edge of the shoulder stock 110 and is a distance d1' as measured at a right angle from the edge portion 118 of the storage compartment 116. Further, the location of the left side opening 254 of the clearance channel 250 on the left side of the shoulder stock 110 is a distance d2 as measured at a right angle from the bottom edge of the shoulder stock 110 and is a distance d2' as measured at a right angle from the edge portion 118 of the storage compartment 116. In one example, for the right side opening 252 of the clearance channel 250, the distance d1 is 35 mm and the distance d1' is 31 mm. For the left side opening 254 of the clearance channel 250, the distance d2 is 43 mm and the distance d2' is 31 mm.

Figure 8:
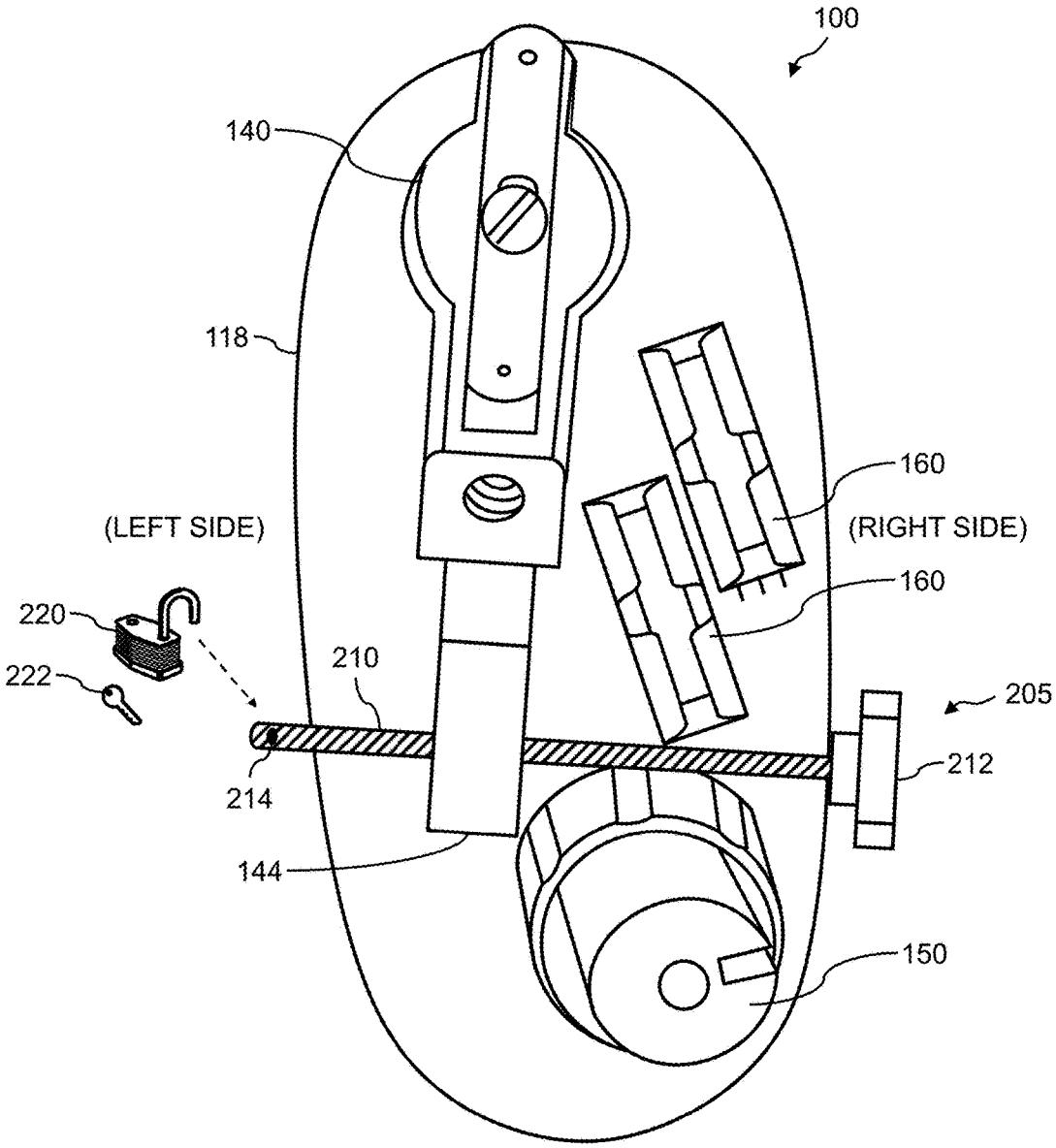

Referring now to FIG. 8 (an end view), the rigid bar 210 of the locking member 205 can be inserted into and through clearance channel 250 in the shoulder stock 110 and the storage compartment 116. The rigid bar 210 of the locking member 205 can be inserted from right to left or from left to right. When fully installed, the knob 212 stops against one side of the shoulder stock 110 and the end of the rigid bar 210 that has the through-hole 214 protrudes from the opposite side of the shoulder stock 110. The through-hole 214 is exposed enough to allow the hasp of the padlock 220 to be engaged with the through-hole 214 and then the padlock 220 locked. Because the path of the clearance channel 250 is through the trigger guard 144, the rigid bar 210 passes through the trigger guard 144. In so doing, the rigid bar 210 prevents the receiver 140 from being removed from the storage compartment 116 of the shoulder stock 110. Namely, when locked with padlock 220, the rigid bar 210 prevents the receiver 140 from being removed from the storage compartment 116 of the shoulder stock 110.

The rigid bar 210 can be, for example, a metal (e.g., stainless steel, aluminum) bar or rod. The length of the rigid bar 210 is at least long enough to pass entirely through the clearance channel 250 and with the through-hole 214 protruding enough to receive the padlock 220. The length of the rigid bar 210 can be, for example, from about 2 inches to about 4 inches. The diameter of the rigid bar 210 can be, for example, about ⅛ inches, or about 3/16 inches, or about ¼ inches. In one example, the diameter of the rigid bar 210 is ¼ inches and the diameter of the through-hole 214 is ⅛ inches. The diameter of the clearance channel 250 need be just slightly larger than the diameter of the rigid bar 210.

Figure 9:
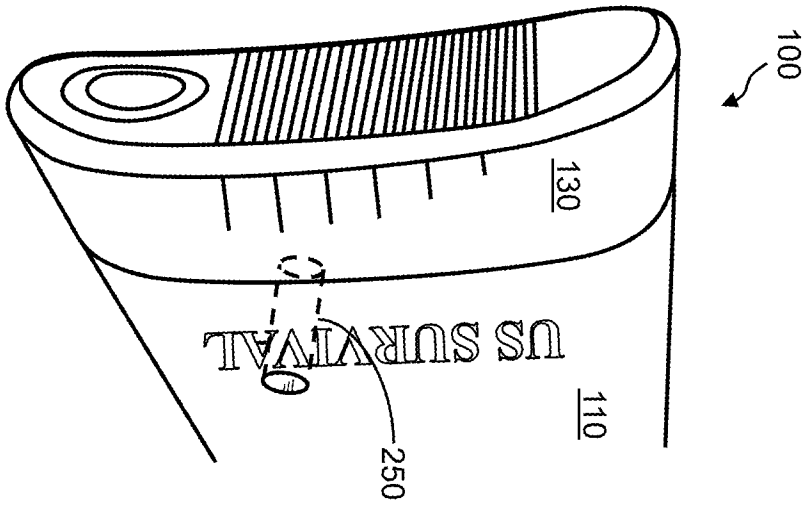
Figure 10:
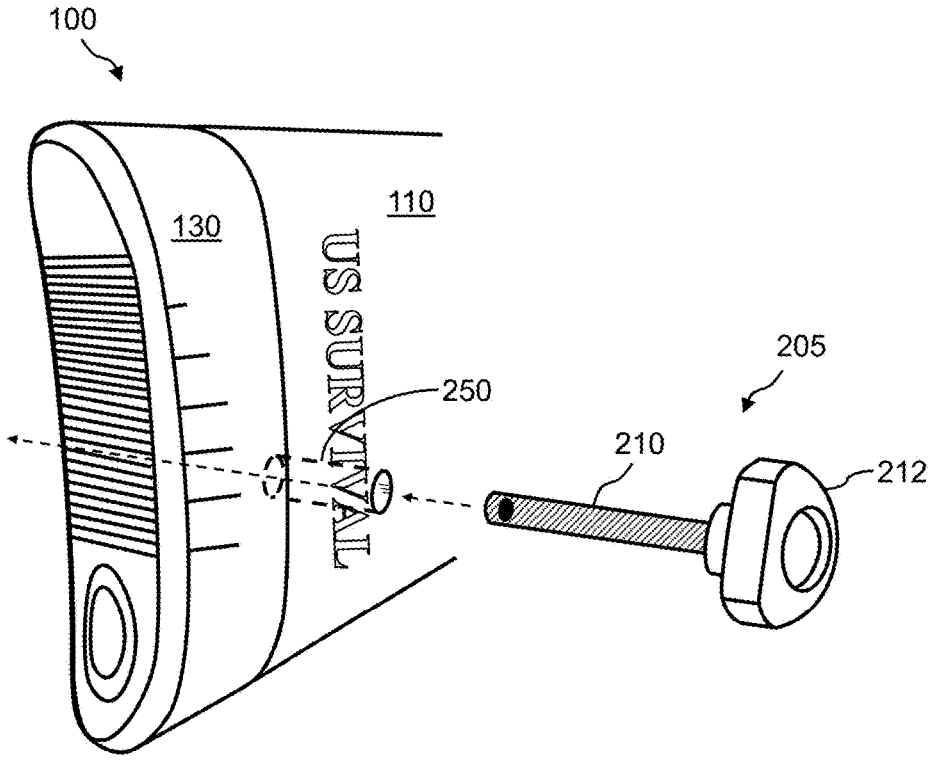
Figure 11:
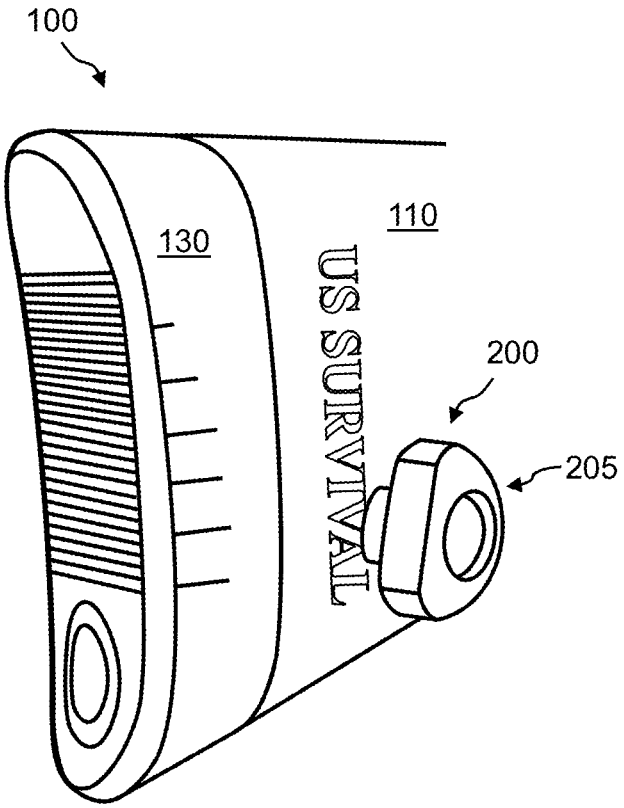
Figure 12:
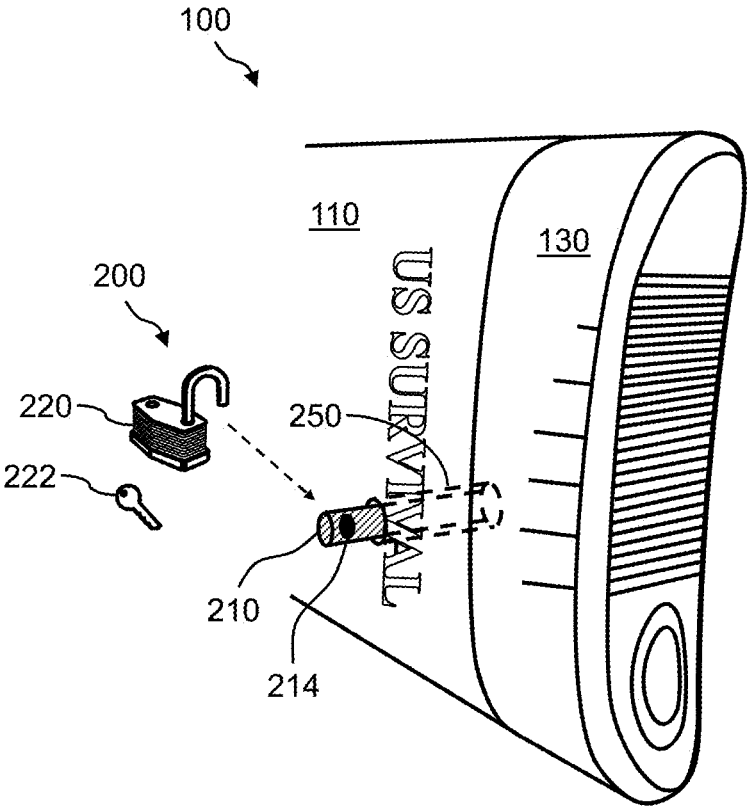
Figure 13:
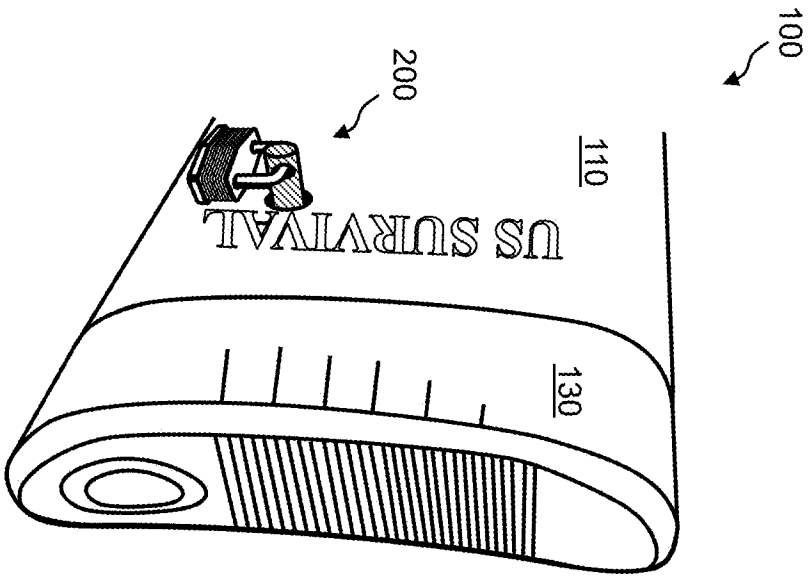

Referring now to FIG. 9 through FIG. 13 is various views showing the process of using the locking mechanism 200 to secure the receiver 140 in the conventional collapsible firearm 100 (e.g., the Henry U.S. Survival AR-7 Rifle). Namely, FIG. 9 shows the conventional collapsible firearm 100 alone without the locking mechanism 200 installed in the clearance channel 250. Next, FIG. 10 shows the locking member 205 on the right side of the shoulder stock 110 and being aligned with the clearance channel 250. Next, FIG. 11 shows the right side of the shoulder stock 110 and the rigid bar 210 of the locking member 205 pushed through the clearance channel 250 until the knob 212 of the locking member 205 is stopped against the shoulder stock 110. In so doing, the rigid bar 210 of the locking member 205 is engaged with the trigger guard 144 (not visible) of the receiver 140 (not visible) that is inside the shoulder stock 110. Next, FIG. 12 shows the left side of the shoulder stock 110 after inserting the rigid bar 210 of the locking member 205 through the clearance channel 250, wherein the distal tip of the rigid bar 210 is protruding and exposing the through-hole 214. The padlock 220 is not yet engaged with the locking member 205. Next, FIG. 13 shows the padlock 220 engaged with the locking member 205. Namely, the hasp of the padlock 220 is engaged with the through-hole 214 of the locking member 205 and then the padlock 220 is locked.

The locking mechanism 200 described herein with reference to FIG. 4 through FIG. 13 is designed to safely secure the receiver 140 only within the shoulder stock 110. However, the presently disclosed subject matter describes other locking mechanisms that can safely secure other components in addition to the receiver 140. Namely, other locking mechanisms are provided that can safely secure one or both magazines 160 in addition to the receiver 140.

For example, FIG. 14, FIG. 15, and FIG. 16 show various views of another example of the locking mechanism 200 that can be used to safely secure the receiver 140 as well as one of the magazines 160 within the conventional collapsible firearm 100 (e.g., the Henry U.S. Survival AR-7 Rifle). In this example, the line or path of the clearance channel 250 is changed as compared with the line or path shown in FIG. 4 through FIG. 13. Namely, FIG. 14 (an end view) shows that the line or path of the clearance channel 250 through the shoulder stock 110 (including the storage compartment 116) is modified to pass through both the trigger guard 144 of the receiver 140 and the magazine 160 closest to the receiver 140. Accordingly, this embodiment of the locking mechanism 200 requires that a through-hole 168 be drilled, bored, or otherwise formed in the magazine 160, as shown, for example, in FIG. 15.

For point of reference, FIG. 15 also shows that the magazine 160 has a leading end 162, a trailing end 164, and a notch 166. The leading end 162 means the end of the magazine 160 that is inserted first into the compartment 122 or the compartment 124 of the storage compartment 116 in the shoulder stock 110. The trailing end 164 means the end of the magazine 160 that is visible when installed in the storage compartment 116. Further, FIG. 15 shows the side of the magazine 160 that is oriented toward the receiver 140 when installed in the compartment 122 or the compartment 124 of the storage compartment 116. That is, the notch 166 is facing the outside (i.e., the right side) of the shoulder stock 110 when the magazine 160 is in the compartment 122 or the compartment 124 of the storage compartment 116.

Namely, in this embodiment of the locking mechanism 200, both the conventional collapsible firearm 100 (e.g., the Henry U.S. Survival AR-7 Rifle) and the magazine 160 require modification. Alternatively, the through-hole 168 can be formed in the magazine 160 during manufacture. FIG. 16 is an end view showing the locking mechanism 200 installed the conventional collapsible firearm 100, wherein the locking mechanism 200 engages both the trigger guard 144 of the receiver 140 and the one magazine 160. The length of the rigid bar 210 of the locking member 205 is adjusted to pass entirely through this line or path of the clearance channel 250 in the shoulder stock 110.

In the locking mechanism 200 shown in FIG. 14, FIG. 15, and FIG. 16, the locking member 205 engages both the receiver 140 and the magazine 160. When locked with padlock 220, the locking member 205 prevents the receiver 140 and the one magazine 160 from being removed from the storage compartment 116 of the shoulder stock 110. In this embodiment, for maximum safety benefit, it may be preferable that the second magazine 160 be omitted from the conventional collapsible firearm 100.

In the locking mechanism 200 shown in FIG. 14, FIG. 15, and FIG. 16, there are two considerations with respect to determining the position of the through-hole 168 in the magazine 160. (1) The position of the through-hole 168 in the magazine 160 must be such that when the magazine 160 is placed in its compartment in the storage compartment 116, the through-hole 168 falls in the line or path of the clearance channel 250. (2) The position of the through-hole 168 in the magazine 160 must be such that the presence of the through-hole 168 does not interfere with the operation of the magazine 160.

For example, FIG. 17, FIG. 18, and FIG. 19 show various views of an example of a two-pronged locking mechanism 400 that can be used to safely secure the receiver 140 as well as both of the magazines 160 within the conventional collapsible firearm 100 (e.g., the Henry U.S. Survival AR-7 Rifle). Referring now to FIG. 17, the two-pronged locking mechanism 400 includes a two-pronged locking member 405 in combination with the padlock 220. The two-pronged locking mechanism 400 is an example of both a trigger locking mechanism and a magazine locking mechanism for a conventional collapsible firearm.

The two-pronged locking member 405 includes a first rigid bar 410 and a second rigid bar 412 that are coupled together on one end and in relation to each other via a plate 414. The first rigid bar 410 and the second rigid bar 412 can be, for example, metal (e.g., stainless steel, aluminum) bars or rods. Similarly, the plate 414 can be, for example, a metal (e.g., stainless steel, aluminum) plate. There is a through-hole 416 at the distal end of the first rigid bar 410 for receiving, for example, the padlock 220. In one example, the ends of the first rigid bar 410 and the second rigid bar 412 are welded to the plate 414. The first rigid bar 410 and the second rigid bar 412 (albeit different lengths) are arranged substantially parallel to each other.

The first rigid bar 410 and the second rigid bar 412 have different lengths. Namely, the first rigid bar 410 is long enough to pass entirely through the shoulder stock 110, while the second rigid bar 412 extends only part way through the shoulder stock 110. For example and referring now to FIG. 18 and FIG. 19, the length of the first rigid bar 410 is at least long enough to pass entirely through the clearance channel 250 and with the first rigid bar 410 protruding enough to receive the padlock 220, wherein the clearance channel 250 is substantially the same path shown in FIG. 14 and FIG. 16. Accordingly, the first rigid bar 410 can be used to engage and secure the receiver 140 and the magazine 160 nearest the receiver 140, as described with reference to the locking mechanism 200 shown in FIG. 14, FIG. 15, and FIG. 16. FIG. 19 shows the second rigid bar 412 engaged with and securing the magazine 160 farthest the receiver 140. The second rigid bar 412 need only be long enough to engage a portion of the magazine 160. The second rigid bar 412 can, but need not, pass entirely through the magazine 160. In other words, the second rigid bar 412 may or may not fully penetrate the magazine 160.

However, in addition to the clearance channel 250 in the conventional collapsible firearm 100, another clearance channel is provided in the shoulder stock 110; namely, a clearance channel 260 that leads from the right side (e.g., via a right side opening 262) of the conventional collapsible firearm 100 to the through-hole 168 in the magazine 160 farthest the receiver 140. The length of the second rigid bar 412 is such to engage at least a portion of the through-hole 168 in the magazine 160 farthest the receiver 140 but without extending beyond the compartment 126 in the storage compartment 116.

In the two-pronged locking mechanism 400 shown in FIG. 17, FIG. 18, and FIG. 19, the two-pronged locking member 405 engages the receiver 140 and both of the magazines 160. When locked with padlock 220, the two-pronged locking member 405 prevents the receiver 140 and both of the magazines 160 from being removed from the storage compartment 116 of the shoulder stock 110.

FIG. 20 illustrates an example of the locations of the ends of the clearance channels 250, 260 shown in FIG. 14 through FIG. 19. In one example, for the right side opening 252 of the clearance channel 250, the distance d1 is 51 mm and the distance d1' is 31 mm. For the left side opening 254 of the clearance channel 250, the distance d2 is 43 mm and the distance d2' is 31 mm. Further, the location of the right side opening 262 of the clearance channel 260 on the right side of the shoulder stock 110 is a distance d3 as measured at a right angle from the bottom edge of the shoulder stock 110 and is a distance d3' as measured at a right angle from the edge portion 118 of the storage compartment 116. In one example, for the right side opening 262 of the clearance channel 260, the distance d3 is 68 mm and the distance d3' is 31 mm.

Referring now to FIG. 21 is a flow diagram of an example of a method 500 of locking the components of a firearm using the presently disclosed locking mechanisms. Namely, using the method 500, the conventional collapsible firearm 100 (e.g., the Henry U.S. Survival AR-7 Rifle) can be safely locked and secured. The method 500 may include, but is not limited to, the following steps.

At a step 510, the conventional collapsible firearm 100 (e.g., the Henry U.S. Survival AR-7 Rifle) is disassembled and the endcap 130 is removed from the shoulder stock 110 of the conventional collapsible firearm 100 (e.g., the Henry U.S. Survival AR-7 Rifle).

At a step 515, the firearm components of the conventional collapsible firearm 100 (e.g., the Henry U.S. Survival AR-7 Rifle) are placed into the compartments of the storage compartment 116 of the shoulder stock 110. For example, the receiver 140 is placed into the compartment 120, the barrel 150 is placed into the compartment 122, the first magazine 160 is placed into the compartment 124, and the second magazine 160 is placed into the compartment 124 of the storage compartment 116 of the shoulder stock 110.

At a step 520, the locking member is inserted through the clearance path(s) in the shoulder stock 110 of the conventional collapsible firearm 100 (e.g., the Henry U.S. Survival AR-7 Rifle), wherein the locking member engages one or more firearm components. In one example, the locking member 205 of the locking mechanism 200 shown in FIG. 4 through FIG. 13 is inserted through the clearance path 250 in the shoulder stock 110, wherein the locking member 205 engages the trigger guard 144 of the receiver 140. In another example, the locking member 205 of the locking mechanism 200 shown in FIG. 14, FIG. 15, and FIG. 16 is inserted through the clearance path 250 in the shoulder stock 110, wherein the locking member 205 engages both the trigger guard 144 of the receiver 140 and the magazine 160 closest to the receiver 140. In yet another example, the two-pronged locking member 405 of the two-pronged locking mechanism 400 shown in FIG. 17, FIG. 18, and FIG. 19 is inserted through the clearance paths 250, 260 in the shoulder stock 110, wherein the two-pronged locking member 405 engages the trigger guard 144 of the receiver 140 and both the magazines 160.

At a step 525, the padlock is engaged into the end of the locking member of the locking mechanism. In one example, in the case of the locking mechanism 200, the padlock 220 is engaged into the end of the locking member 205 as shown in FIG. 13 and FIG. 16. In another example, in the case of the locking mechanism 400, the padlock 220 is engaged into the end of the two-pronged locking member 405 as shown in FIG. 19.

At a step 530, the endcap 130 is reinstalled onto the shoulder stock 110 of the conventional collapsible firearm 100 (e.g., the Henry U.S. Survival AR-7 Rifle).

Referring now to FIG. 22 is a flow diagram of an example of a method 600 of unlocking the components of a firearm using the presently disclosed locking mechanisms. The method 600 may include, but is not limited to, the following steps.

At a step 610, the padlock is unlocked and removed from the end of the locking member of the locking mechanism. In one example, in the case of the locking mechanism 200, using the key 222 or a unique combination, the padlock 220 is unlocked and removed from the end of the locking member 205. In another example, in the case of the locking mechanism 400, using the key 222 or a unique combination, the padlock 220 is unlocked and removed from the end of the two-pronged locking member 405.

At a step 615, the locking member of the locking mechanism is removed from the clearance path(s) in the shoulder stock 110 of the conventional collapsible firearm 100 (e.g., the Henry U.S. Survival AR-7 Rifle), wherein locking member disengages from one or more firearm components. In one example, the locking member 205 of the locking mechanism 200 shown in FIG. 4 through FIG. 13 is removed from the clearance path 250 in the shoulder stock 110, wherein the locking member 205 disengages the trigger guard 144 of the receiver 140. In another example, the locking member 205 of the locking mechanism 200 shown in FIG. 14, FIG. 15, and FIG. 16 is removed from the clearance path 250 in the shoulder stock 110, wherein the locking member 205 disengages both the trigger guard 144 of the receiver 140 and the magazine 160 closest to the receiver 140. In yet another example, the two-pronged locking member 405 of the two-pronged locking mechanism 400 shown in FIG. 17, FIG. 18, and FIG. 19 is removed from the clearance paths 250, 260 in the shoulder stock 110, wherein the two-pronged locking member 405 disengages the trigger guard 144 of the receiver 140 and both the magazines 160.

At a step 620, the endcap 130 is removed from the shoulder stock 110 of the conventional collapsible firearm 100 (e.g., the Henry U.S. Survival AR-7 Rifle).

At a step 625, the firearm components (e.g., the receiver 140, the barrel 150, the magazines 160) are removed from the compartments in the shoulder stock 110 of the conventional collapsible firearm 100 (e.g., the Henry U.S. Survival AR-7 Rifle).

At a step 630, the endcap 130 is reinstalled onto the shoulder stock 110 and the conventional collapsible firearm 100 (e.g., the Henry U.S. Survival AR-7 Rifle) is assembled.

Referring now to FIG. 23, FIG. 24, and FIG. 25 is various views of still another example of the presently disclosed locking mechanisms that can be used with a conventional collapsible firearm 100 that has been modified, such as the modified Henry U.S. Survival AR-7 Rifle. In this example, the locking member is a zip tie 700 and the "key" is any type of cutting tool 710, such as any type of wire cutter or scissors. The zip tie 700 can be a standard nylon or stainless steel zip tie (aka tie wrap or cable tie). In operation, FIG. 24 shows that the zip tie 700 passes through the clearance channel 250 and then wraps (in either direction) around a portion of the shoulder stock 110. The ends of the zip tie 700 engage in a locking fashion that is well known. In so doing, the zip tie 700 engages with, for example, the trigger guard 144 of the receiver 140, whereby the receiver 140 is considered "locked." Accordingly, the zip tie 700 prevents the receiver 140 from being removed from the shoulder stock 110. The zip tie 700, which is the "lock," can be "unlocked" by cutting it with the cutting tool 710, which is the "key." FIG. 24 shows the zip tie 700 engaged with the trigger guard 144 of the receiver 140 only, whereas FIG. 25 shows the zip tie 700 engaged with both the trigger guard 144 of the receiver 140 and one of the magazines 160.

FIG. 26 illustrates an example of the presently disclosed locking mechanism, namely, the zip tie 700, that can be used to perform an additional task of securing the endcap 130 to the shoulder stock 110 and thereby rendering the shoulder stock 110 itself a locked container. Namely, not only does the zip tie 700 engage with the trigger guard 144 of the receiver 140 and/or one of the magazines 160, it also wraps around the endcap 130 and prevents the endcap 130 from being removed.

The conventional collapsible firearm 100 (e.g., the Henry U.S. Survival AR-7 Rifle) is known to be able to float in water for some period of time (e.g., a few minutes) due to the foam-filled or hollow shoulder stock 110. Therefore, in the event that the conventional collapsible firearm 100 is accidently dropped in water, this ability to float for some period of time (e.g., a few minutes) allows time for easy retrieval. As such, the presence of the presently disclosed locking mechanisms, such as locking mechanism 200, can compromise this ability to float. This is due to the presence of the clearance channel 250, which may provide a path by which water may enter the shoulder stock 110. To mitigate this risk, it may be beneficial to make the clearance channel 250 leak proof or at least leak resistant.

The conventional collapsible firearm 100 (e.g., the Henry U.S. Survival AR-7 Rifle) is known to be able to float in water for some period of time (e.g., a few minutes) due to the foam-filled or hollow shoulder stock 110. Therefore, in the event that the conventional collapsible firearm 100 is accidently dropped in water, this ability to float for some period of time (e.g., a few minutes) allows time for easy retrieval. As such, the presence of the presently disclosed locking mechanisms, such as locking mechanism 200, can compromise this ability to float. This is due to the presence of the clearance channel 250, which may provide a path by which water may enter the shoulder stock 110. To mitigate this risk, it may be beneficial to make the clearance channel 250 leak proof or at least leak resistant. For example, FIG. 27A and FIG. 27B show an example of a method of making the shoulder stock 110 leak proof or at least leak resistant with the presently disclosed locking mechanism (e.g., locking mechanism 200) installed. In this example, a grommet 470, such as a rubber or silicon grommet, is provided at each opening of the clearance channel 250. Namely, one grommet 470 on or in each side of the shoulder stock 110. As a result, when the rigid bar 210 of the locking member 205 is inserted through the clearance channel 250, the two grommets 470 fit snugly around the rigid bar 210 to provide a substantially leak proof or at least leak resistant interface.

Referring again to FIG. 1 through FIG. 27B, the presently disclosed locking mechanisms is not limited to locking mechanism 200 and two-pronged locking mechanism 400. These are exemplary only. Any locking mechanisms are possible wherein one or more rigid bars can pass through the shoulder stock or butt and/or handgrip to provide a trigger locking mechanism, a magazine locking mechanism, or both a trigger locking mechanism and a magazine locking mechanism. Further, the presently disclosed locking mechanisms is not limited to rigid bars such as used in locking mechanism 200 and two-pronged locking mechanism 400. Other locking mechanisms are possible. For example, with reference to FIG. 28A through FIG. 35C below, the presently disclosed locking mechanisms can be rigid bars and/or keyed cylinder locks.

Referring now to FIG. 28A and FIG. 28B is various views of two examples of cylinder locks, which are yet other examples of the presently disclosed locking mechanisms that can be used with the conventional collapsible firearm 100 (e.g., the Henry U.S. Survival AR-7 Rifle) that has been modified. In a first example, FIG. 28A shows a cylinder lock 800 (not to scale), which is a keyed cylinder lock. The cylinder lock 800 includes a cylinder portion 810. When in use, the exposed end of the cylinder portion 810 includes a key slot 812 and the opposite end of the cylinder portion 810 includes a latch mechanism 814. In one example, the latch mechanism 814 is a hook. The cylinder lock 800 further includes a cylinder body 816 for receiving the cylinder portion 810, wherein the cylinder portion 810 is rotatable within the cylinder body 816. Further, the cylinder body 816 has an alignment or key feature 818 for orienting the cylinder lock 800 when installed. A key 820 is provided for fitting into the key slot 812 of the cylinder portion 810 and locking and unlocking the cylinder lock 800. The EuroSpec MP5 and MP10 cylinder locks are examples of cylinder locks that have an alignment or key feature 818.

In one example, using key 820, the cylinder portion 810 is rotatable about a quarter turn within the cylinder body 816. Generally, the cylinder portion 810 is not removable from the cylinder body 816. As a result, the entire assembly of the cylinder lock 800 is installable and then removable from the conventional collapsible firearm 100. However, optionally the cylinder body 816 of the cylinder lock 800 can be permanently installed in the conventional collapsible firearm 100 while only the cylinder portion 810 with the latch mechanism 814 is removable.

In a second example, FIG. 28B shows a cylinder lock 850 (not to scale), which is a keyed cylinder lock. The cylinder lock 850 includes the cylinder portion 810 with the latch mechanism 814 as described in FIG. 28A. The cylinder lock 850 further includes a cylinder body 852 for receiving the cylinder portion 810, wherein the cylinder portion 810 is rotatable within the cylinder body 852. In this example, the cylinder body 852 does not include an alignment or key feature. Further, in this example, the cylinder body 852 of the cylinder lock 850 is permanently installed in the conventional collapsible firearm 100 and only the cylinder portion 810 with the latch mechanism 814 is removable. Using key 820, the cylinder portion 810 is rotatable about a quarter turn with respect to the cylinder body 852.

Figure 29A:
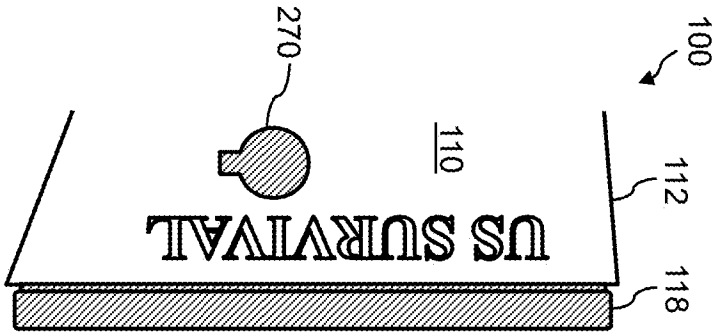
Figure 29B:
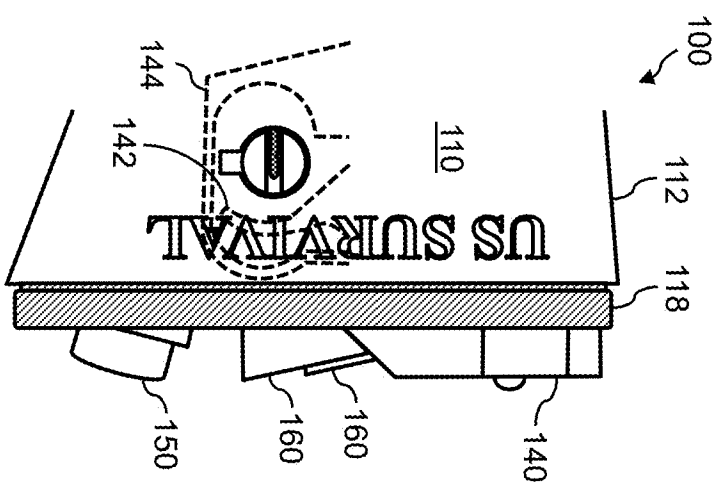
Figure 29C:
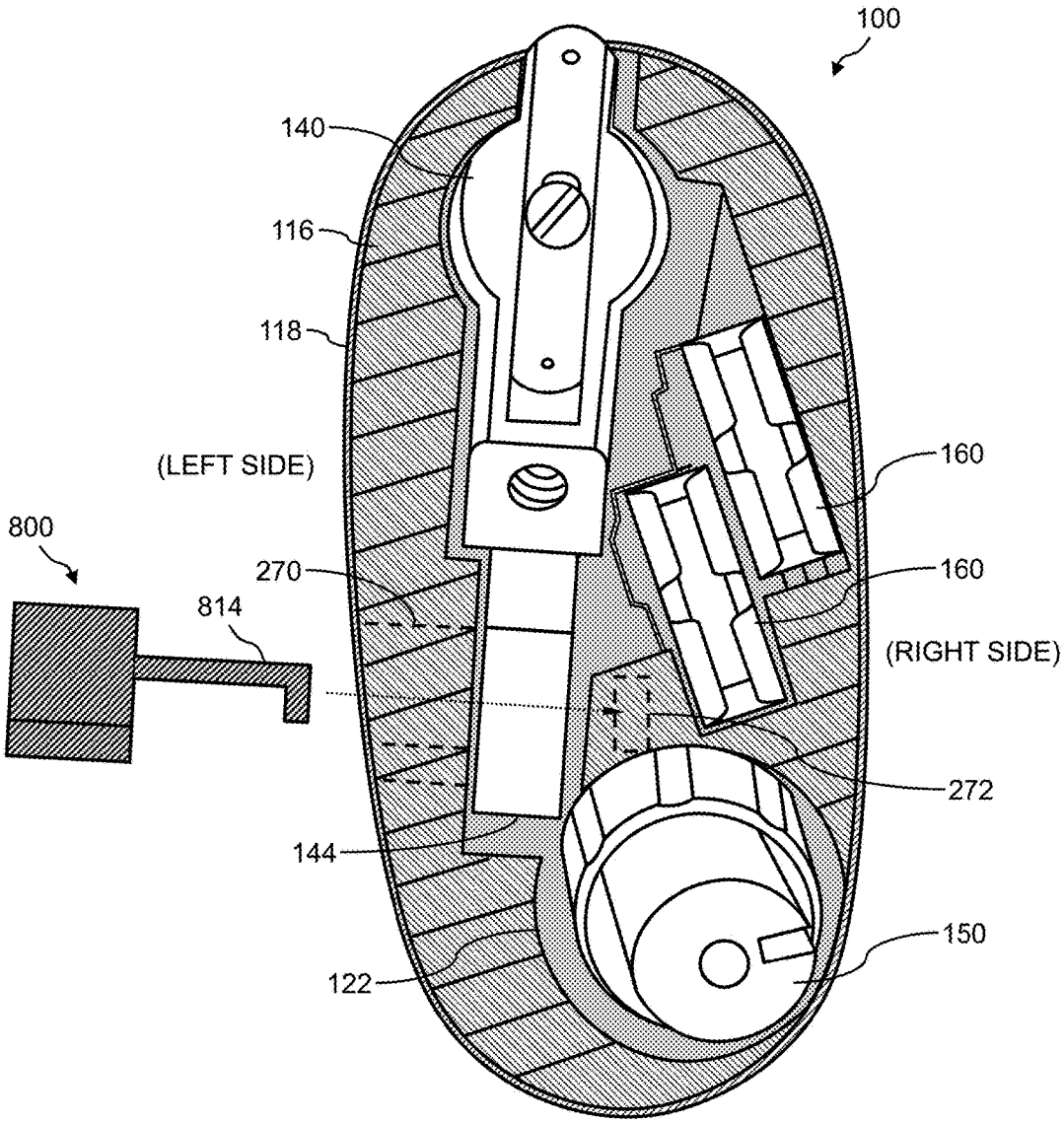
Figure 29D:
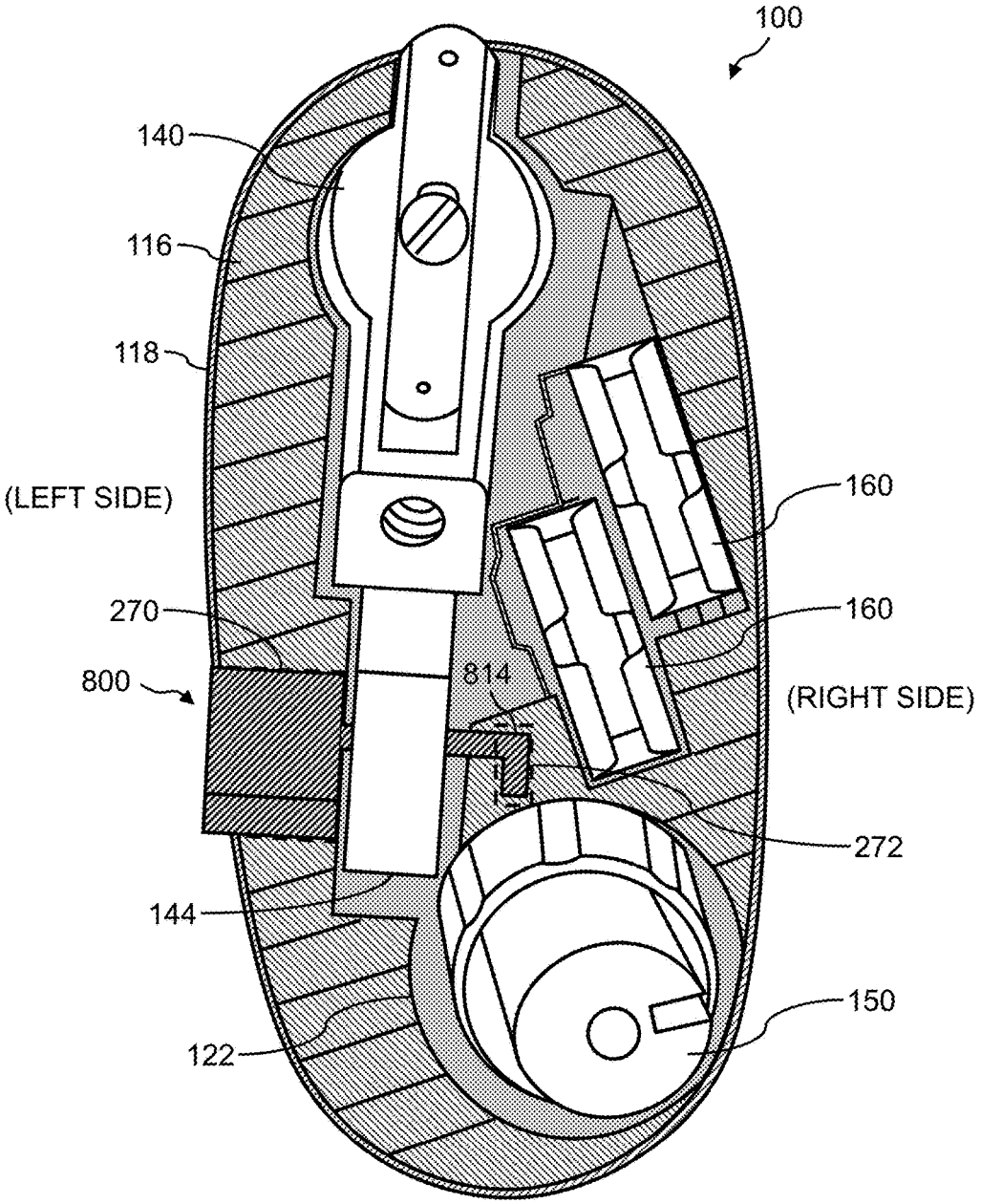
Figure 30A:
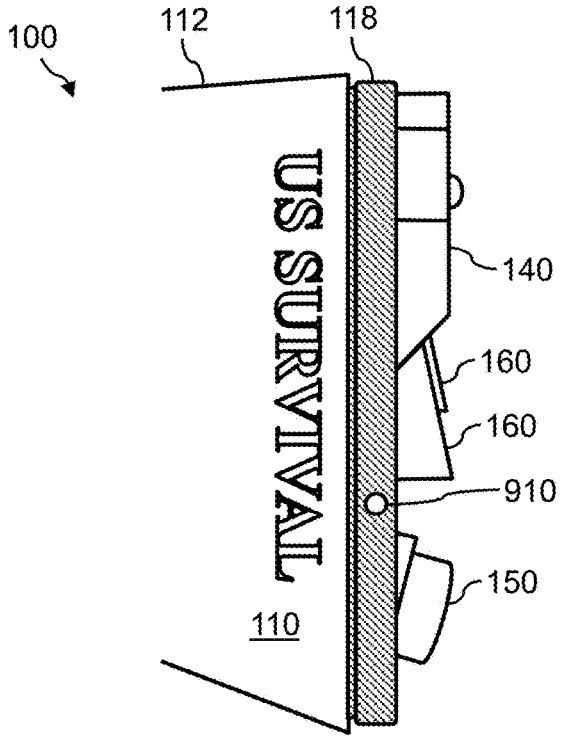
Figure 30B:
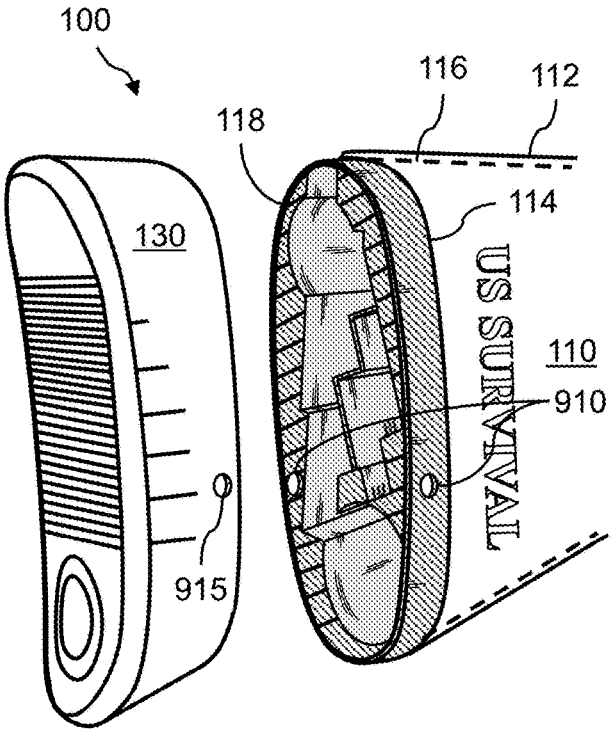
Figure 30C:
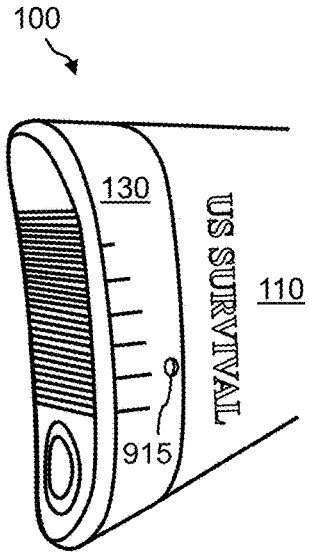
Figure 30D:
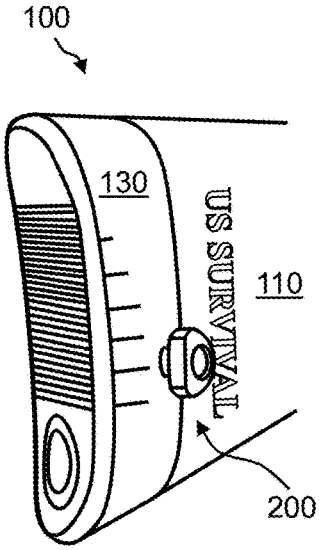
Figure 30E:
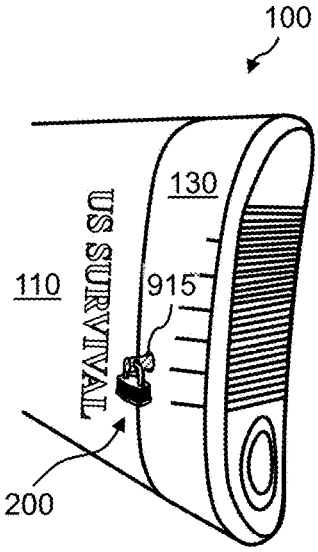

Referring now to FIG. 29A, FIG. 29B, FIG. 29C, and FIG. 29D is various views of an example of the conventional collapsible firearm 100 (e.g., the Henry U.S. Survival AR-7 Rifle) that is modified to receive the cylinder lock shown in FIG. 28A and wherein the cylinder lock 800 acts as a trigger lock. For example, FIG. 29A shows a cavity or opening 270 in the left side of the shoulder stock 110 for receiving the cylinder lock 800. FIG. 29B shows that the location of the cavity or opening 270 and the cylinder lock 800 is set to substantially align with the forward portion of the trigger guard 144 of the receiver 140. FIG. 29D shows the path of the latch mechanism 814 of the cylinder lock 800 passing through the trigger guard 144. Further, FIG. 29C shows a slot or cavity 272 in the storage compartment 116 for receiving the latch mechanism 814 of the cylinder lock 800. Namely, in the "unlocked" position, the latch mechanism 814 of the cylinder lock 800 can enter the slot or cavity 272 in the storage compartment 116. Then, with, for example, a quarter turn of the key 820, the latch mechanism 814 can engage with the edge of the slot or cavity 272 in the storage compartment 116 as shown in FIG. 29D. The cylinder lock 800 is thereby in the "locked" position because the receiver 140 cannot be removed from the shoulder stock 110.

Referring now to FIG. 30A, FIG. 30B, FIG. 30C, FIG. 30D, and FIG. 30E is various views of an example of the conventional collapsible firearm 100 (e.g., the Henry U.S. Survival AR-7 Rifle) that is modified to lock the endcap thereof and thereby render the shoulder stock 110 itself a locked container. In this example, a channel 910 is provided from one side to the other of the edge portion 118 of the storage compartment 116 (see FIG. 30A and FIG. 30B). Currently, the edge portion 118 of the storage compartment 116 protrudes past the edge of the shoulder stock 110 about ⅜ inches. However, in other embodiments, the edge portion 118 of the storage compartment 116 may be extended, for example, to about ½ inch or ¾ inches past the edge of the shoulder stock 110. A corresponding channel 915 is provided from one side to the other of the mating edge of the endcap 130. Accordingly, when the endcap 130 is installed on the shoulder stock 110, the channel 915 substantially aligns with the channel 910 (see FIG. 30B and FIG. 30C). Further, when the endcap 130 is installed on the shoulder stock 110, the locking mechanism 200 can be installed through the channels 910, 915 (see FIG. 30D and FIG. 30E) and thereby locking the endcap 130 to the shoulder stock 110. In so doing, access to the components stored within the shoulder stock 110 is prevented. Accordingly, the shoulder stock 110 itself can be a locked container, wherein the shoulder stock 110 may meet federal, state, and/or local regulations with respect to locked containers for firearms.

Whereas FIG. 30A, FIG. 30B, FIG. 30C, FIG. 30D, and FIG. 30E show the locking mechanism 200 installed side-to-side with respect to the endcap 130, in another example, FIG. 31 shows the locking mechanism 200 installed top-to-bottom with respect to the endcap 130. Again, rendering the shoulder stock 110 itself a locked container. Further, in the examples shown in FIG. 30A, FIG. 30B, FIG. 30C, FIG. 30D, and FIG. 30E and FIG. 31, a zip tie (aka tie wrap or cable tie), such as the zip tie 700, may be used in place of the locking mechanism 200.

Figure 32A:
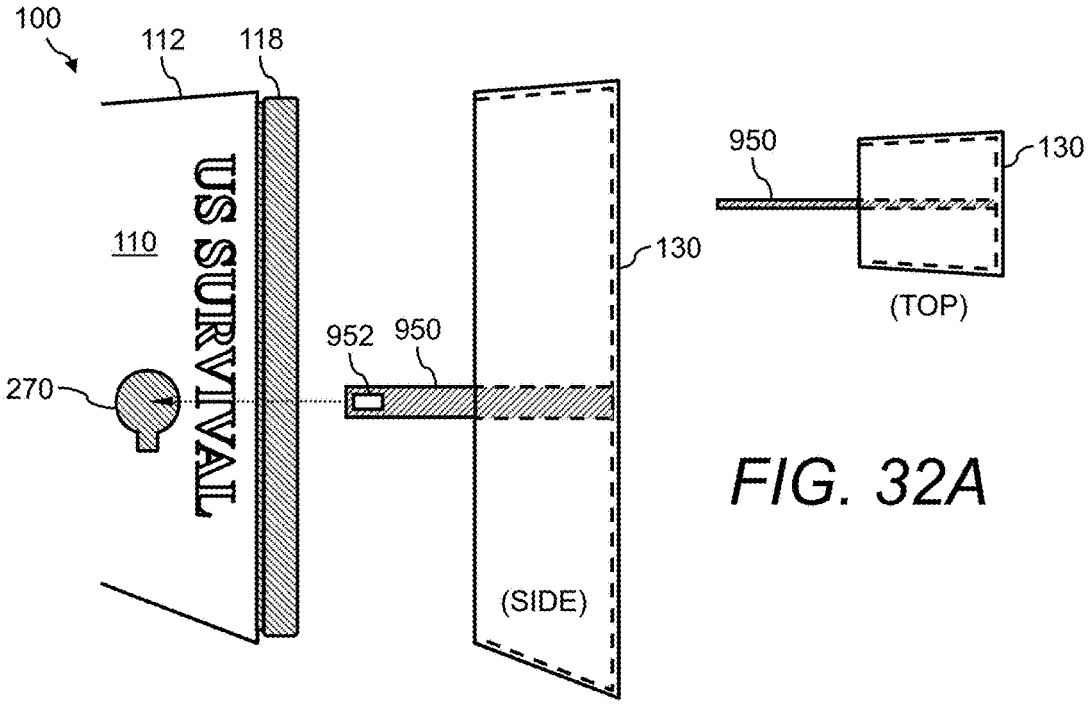
Figure 32B:
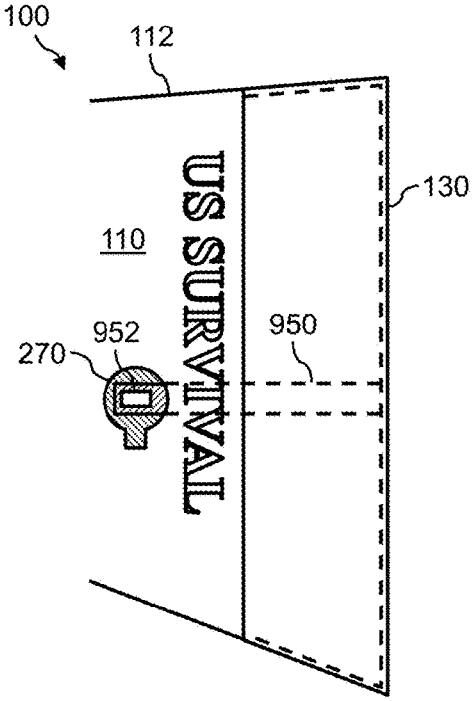
Figure 32C:
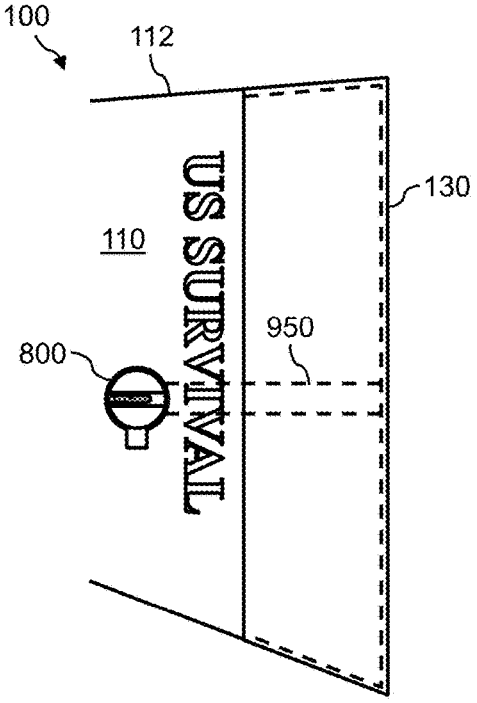
Figure 32D:
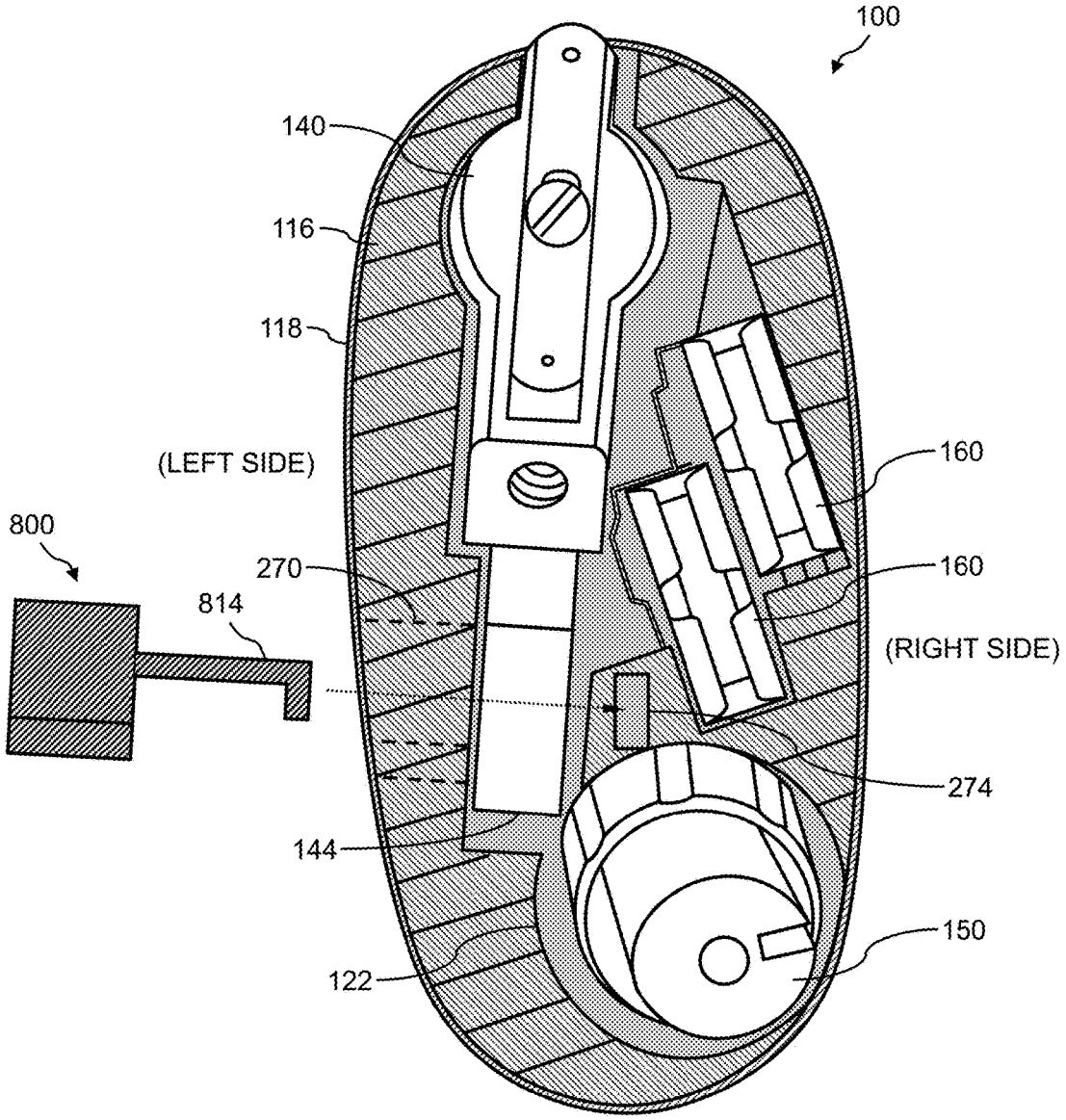

Referring now to FIG. 32A, FIG. 32B, FIG. 32C, and FIG. 32D is various views of yet another example of the conventional collapsible firearm 100 (e.g., the Henry U.S. Survival AR-7 Rifle) that is modified to lock the endcap 130 and thereby render the shoulder stock 110 itself a locked container. In this example, a locking member 950 is provided, wherein the locking member 950 protrudes substantially normal from the back of the endcap 130 and extends toward the shoulder stock 110. Further, an opening 952 is provided in the end of the locking member 950 that is toward the shoulder stock 110. Further, a slot or cavity 274 (see FIG. 32D) is provided in the end of the storage compartment 116 for receiving the locking member 950 when the endcap 130 is installed on the shoulder stock 110. FIG. 32A shows the endcap 130 separated from the shoulder stock 110; namely, a side view and a top view of the endcap 130 with the locking member 950. The locking member 950 can be, for example, a flat plastic plate that is fully integrated (i.e., via molded plastic) with the endcap 130.

The locking member 950 is designed to be inserted into the shoulder stock 110 and engaged with, for example, the cylinder lock 800 and thereby secure the endcap 130 to the shoulder stock 110. Accordingly, the cavity or opening 270 in the side of the shoulder stock 110 (for receiving cylinder lock 800) is positioned to substantially align with the opening 952 in the locking member 950 when the locking member 950 is inserted into the shoulder stock 110 (see FIG. 32B). Once the endcap 130 is installed on the shoulder stock 110, the cylinder lock 800 can be installed in the cavity or opening 270 in the side of the shoulder stock 110, wherein the latch mechanism 814 of the cylinder lock 800 can engage with the opening 952 in the locking member 950 (see FIG. 32C). In this way, the endcap 130 is secured or locked to the shoulder stock 110. Accordingly, the shoulder stock 110 itself can be a locked container, wherein the shoulder stock 110 may meet federal, state, and/or local regulations with respect to locked containers for firearms.

Instead of the locking member 950 protruding from the endcap 130 and being secured by, for example, the cylinder lock 800 in the shoulder stock 110, the locking member 950 can protrude from the shoulder stock 110 and be secured by, for example, the cylinder lock 800 in the endcap 130. For example, FIG. 33A, FIG. 33B, and FIG. 33C shows the locking member 950 protruding from the storage compartment 116 in the shoulder stock 110 and with the opening 952 extending toward the endcap 130 (see FIG. 33A). Again, the locking member 950 can be, for example, a flat plastic plate that is fully integrated (i.e., via molded plastic) with the storage compartment 116.

The cavity or opening 270 is provided in the side of the endcap 130 (for receiving cylinder lock 800) and positioned to substantially align with the opening 952 in the locking member 950 when the locking member 950 is inserted into the shoulder stock 110 (see FIG. 33B). Once the endcap 130 is installed on the shoulder stock 110, the cylinder lock 800 can be installed in the cavity or opening 270 in the side of the endcap 130, wherein the latch mechanism 814 of the cylinder lock 800 can engage with the opening 952 in the locking member 950 (see FIG. 33C). In this way, the endcap 130 is secured or locked to the shoulder stock 110. Accordingly, the shoulder stock 110 itself can be a locked container, wherein the shoulder stock 110 may meet federal, state, and/or local regulations with respect to locked containers for firearms.

Referring now to FIG. 34A, FIG. 34B, and FIG. 34C is various views of still another example of the conventional collapsible firearm 100 (e.g., the Henry U.S. Survival AR-7 Rifle) that is modified to lock the endcap 130 and thereby render the shoulder stock 110 itself a locked container. In this example, one end (e.g., the top end) of the endcap 130 is hingeably coupled to the shoulder stock 110. In one example, a standard hinge 280 is provided at interface between the top of the endcap 130 and the shoulder stock 110 (see FIG. 34A). In another example, the hinge may be implemented via a hook and slot configuration (not shown); either a hook in the endcap 130 and a slot in the shoulder stock 110 or the hook in the shoulder stock 110 and a slot in the endcap 130. When the hook is engaged in the slot, it functions as a hinge and also holds one end of the endcap 130 secure to the shoulder stock 110. The end of the endcap 130 that is opposite hinge 280 can be secured or locked to the shoulder stock 110 via, for example, the cylinder lock 800. Further, a slot or cavity 282 (see FIG. 34A and FIG. 34B) is provided in the end of the storage compartment 116 for receiving the latching mechanism 814 when the endcap 130 is installed on the shoulder stock 110.

In this example, the cavity or opening 270 is provided in the end of the endcap 130 (for receiving cylinder lock 800. Once the endcap 130 is installed on the shoulder stock 110, the cylinder lock 800 can be installed in the cavity or opening 270 in the end of the endcap 130, wherein the latch mechanism 814 of the cylinder lock 800 can engage with the slot or cavity 282 in the storage compartment 116 (see FIG. 34B and FIG. 34C). In this way, the endcap 130 is secured or locked to the shoulder stock 110. Accordingly, the shoulder stock 110 itself can be a locked container, wherein the shoulder stock 110 may meet federal, state, and/or local regulations with respect to locked containers for firearms.

The cylinder lock 800 in the endcap 130 is not limited to the configuration shown in FIG. 34A, FIG. 34B, and FIG. 34C. In another example and referring now to FIG. 35A, FIG. 35B, and FIG. 35C, the cylinder lock 800 in installed in the bottom edge of the endcap 130 (i.e., opposite the hinge 280) rather than in the end of the endcap 130. In this example, it may be necessary to extend the edge portion 118 of the storage compartment 116 outward in order to engage with the latch mechanism 814 or the cylinder lock 800 or a locking member 950 (not shown) may be provided for receiving the latch mechanism 814 of the cylinder lock 800.

Again, the conventional collapsible firearm 100 (e.g., the Henry U.S. Survival AR-7 Rifle) is known to be able to float in water for some period of time (e.g., a few minutes) due to the foam-filled or hollow shoulder stock 110. Accordingly, with respect to the use of the cylinder locks, such as the cylinder locks 800, 850, shown in FIG. 29A through FIG. 35C, a grommet (not shown), such as a rubber or silicon grommet, may be provided with respect to the cylinder lock in order to ensure that the shoulder stock 110 and/or the endcap 130 is leak proof or at least leak resistant with the presently disclosed locking mechanism (e.g., the cylinder lock 800) installed.

Further, the conventional collapsible firearm 100 into which the presently disclosed locking mechanisms can be installed is not limited to the Henry U.S. Survival AR-7 Rifle. This is exemplary only. Another example of the conventional collapsible firearm 100 is the Mauser C96. Accordingly, the paths of the locking members (e.g., rigid bar 210 of locking member 205 and first rigid bar 410 and second rigid bar 412 of two-pronged locking member 405) through the shoulder stock or butt and/or handgrip is not limited to those shown in FIG. 1 through FIG. 27B. Further, the locations of the cylinder locks, such as the cylinder locks 800, 850, in the shoulder stock or butt and/or handgrip is not limited to those shown in FIG. 29A through FIG. 35C. Further, the number, locations, and/or angles of the locking members can vary with respect to the shoulder stock or butt and/or handgrip depending on the type/brand of conventional collapsible firearm 100 and/or the configuration of the firearm components within the shoulder stock or butt and/or handgrip.

Additionally, in other embodiments and referring again to FIG. 1 through FIG. 35C, the shoulder stock 110 of the conventional collapsible firearm 100 may not comprise the two-piece combination of the butt end outer shell 112 and the storage compartment 116 installed therein. Rather, the shoulder stock 110 may be a one-piece solid structure formed of, for example, molded plastic that includes all of the compartments (e.g., compartments 120, 122, 124, 126) for holding the components of the conventional collapsible firearm 100. Accordingly, the locking mechanisms described hereinabove can be installed with respect to the one-piece shoulder stock 110.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A locking mechanism for a collapsible firearm, comprising:

a. one or more locking members, comprising a first end and a second end, the first end comprising a stop, wherein the one or more locking members are configured to be received by one or more clearance channels formed in one of a shoulder stock, butt, or handgrip of the collapsible firearm, and wherein a first one of the one or more locking members is configured to pass through a first one of the one or more clearance channels from a first exterior side to a second exterior side of the one of the shoulder stock, butt, or handgrip, such that a portion of the second end of the at least one of the one or more locking members protrudes from the second exterior side of the one of the shoulder stock, butt, or handgrip; and b. a securing mechanism configured to engage with the second end of the first one of the one or more locking members that protrudes from the second exterior side of the one of the shoulder stock, butt, or handgrip.

2. The locking mechanism of claim 1, wherein the second end of the first one of the one or more locking members comprises a through hole configured to engage with the securing mechanism.

3. The locking mechanism of claim 1, wherein the securing mechanism comprises any one of a lock, cable tie, or zip tie.

4. The locking mechanism of claim 1, wherein the first one of the one or more locking members is configured to pass through the first one of the one or more clearance channels, such that when installed the first one of the locking member passes through a trigger guard and a front or back side of a trigger of a receiver of the collapsible firearm when in a collapsed configuration and the receiver is stored in the one of the shoulder stock, butt, or handgrip.

5. The locking mechanism of claim 1, further comprising a second of the one or more locking members, wherein the second of the one or more locking members, is configured to pass through a second one of the one or more clearance channels and, when installed, is configured to engage with a magazine of the collapsible firearm when in a collapsed configuration and the magazine is stored in the one of the shoulder stock, butt, or handgrip.

6. The locking mechanism of claim 5, wherein the second of the one or more locking members is configured to engage with the magazine by extending at least partially into a through-hole or notch formed in the magazine.

7. The locking mechanism of claim 5, wherein the first one of the one or more locking member pass through a through-hole formed in a first magazine and through a trigger guard and a front or back side of a trigger of a receiver, and the second of the one or more locking members engages with a second magazine of the collapsible firearm when in a collapsed configuration and the first and second magazine and receiver are stored in the one of the shoulder stock, butt, or handgrip.

8. The locking mechanism of claim 1, wherein the first one of the one or more locking members is configured such that when it passes through the shoulder stock, butt, or handgrip, and the securing mechanism is engaged with its second end one or more components of the of the collapsible firearm stored therein are secured in place.

9. The locking mechanism of claim 1, further comprising a grommet provided at each opening of the one or more clearance channels.

10. The locking mechanism of claim 9, wherein the grommet comprises a plastic, rubber, silicon, or composite material grommet.

11. The locking mechanism of claim 9, wherein the grommet comprises a waterproof or semi-waterproof grommet, and is configured to provide a waterproof or semi-waterproof seal at each opening of the one or more clearance channels.

12. The locking mechanism of claim 1, wherein the stop is larger than the diameter of the one or more clearance channels and is configured to prevent the first end of the one or more locking members from passing through the first exterior side of the one of the shoulder stock, butt, or handgrip.

13. A collapsible firearm with a locking mechanism; comprising:

a. collapsible firearm; and b. a locking mechanism, the locking mechanism comprising:

i. one or more locking members, comprising a first end and a second end, the first end comprising a stop, wherein the one or more locking members are configured to be received by one or more clearance channels formed in one of a shoulder stock, butt, or handgrip of the collapsible firearm, and wherein a first one of the one or more locking members is configured to pass through a first one of the one or more clearance channels from a first exterior side to a second exterior side of the one of the shoulder stock, butt, or handgrip, such that a portion of the second end of the at least one of the one or more locking members protrudes from the second exterior side of the one of the shoulder stock, butt, or handgrip; and ii. a securing mechanism configured to engage with the second end of the first one of the one or more locking members that protrudes from the second exterior side of the one of the shoulder stock, butt, or handgrip.

14. A locking mechanism for a collapsible firearm, comprising:

a. a cylinder lock, comprising:

i. a cylinder body; and ii. a cylinder, the cylinder comprising a latch mechanism at a first end, wherein the cylinder is rotatable within the cylinder body; and wherein the cylinder lock is configured to be received in an opening formed in a portion of one of a shoulder stock, butt, or handgrip of the collapsible firearm, such that when installed the latch mechanism is lockably engagable with a corresponding latch catch, wherein the latch catch is formed in an interior portion of a storage compartment of the one of the shoulder stock, butt, or handgrip.

15. The locking mechanism of claim 14, wherein the opening is formed in a side portion of the one of the shoulder stock, butt, or handgrip.

16. The locking mechanism of claim 15, wherein the latch mechanism is further configured to be lockably engagable with a corresponding portion of a locking member, wherein the locking member extends from an endcap of the one of the shoulder stock, butt, or handgrip and towards the storage compartment when the endcap is installed thereon.

17. The locking mechanism of claim 15, wherein when installed the cylinder lock is substantially aligned with a trigger guard of a receiver of the collapsible firearm stored within the storage compartment of the one of the shoulder stock, butt, or handgrip, and the latch mechanism is further configured to pass through the trigger guard.

18. The locking mechanism of claim 14, wherein the latch mechanism comprises a hook portion.

19. The locking mechanism of claim 14, wherein the latch catch comprises one of a slot and cavity configured to be engagable with the latch mechanism when the cylinder lock is installed.

20. The locking mechanism of claim 14, wherein the cylinder further comprises a key slot configured such that when engaged by a corresponding key the cylinder is rotatable within the cylinder body, and wherein rotation of the cylinder within the cylinder body causes the latch mechanism to at least one of lockably engage and disengage with the latch catch of the storage compartment.

21. The locking mechanism of claim 14, wherein the cylinder body comprising an alignment feature configured to orientate the cylinder lock in a set position when installed in the opening of the one of the shoulder stock, butt, or handgrip.

22. The locking mechanism of claim 14, wherein the cylinder lock is installable and removable from the opening of the one of the shoulder stock, butt, or handgrip.

23. The locking mechanism of claim 14, wherein the cylinder is installable and removable from the opening of the one of the shoulder stock, butt, or handgrip.

24. The locking mechanism of claim 14, wherein the opening for receiving the cylinder lock is formed in an endcap of the one of the shoulder stock, butt, or handgrip.

25. The locking mechanism of claim 24, wherein the opening for receiving the cylinder lock is formed in any one of a side, end, bottom, and top portion of the endcap of the one of the shoulder stock, butt, or handgrip.

26. The locking mechanism of claim 24, wherein the latch catch for engaging with the latch mechanism comprises a locking member extending from the storage compartment toward the endcap, wherein the locking member is configured to be engagable with the latch mechanism.

27. The locking mechanism of claim 14, wherein the cylinder lock is configured such that when installed in the opening of the one of the shoulder stock, butt, or handgrip, and engaged in a locked position one or more components of the collapsible firearm stored within the storage compartment are not removable.

28. The locking mechanism of claim 14, wherein the cylinder lock is configured such that when installed in the opening of the one of the shoulder stock, butt, or handgrip, and engaged in a locked position an endcap of the one of the shoulder stock, butt, or handgrip is not removable, therefore locking in components of the collapsible firearm stored within the storage compartment.

29. The locking mechanism of claim 28, wherein the endcap is configured such that when locked in place the storage compartment comprises a locked container.

30. A collapsible firearm with a locking mechanism; comprising:

a. collapsible firearm; and b. a cylinder lock, comprising:

i. a cylinder body; and ii. a cylinder, the cylinder comprising a latch mechanism at a first end, wherein the cylinder is rotatable within the cylinder body; and wherein the cylinder lock is configured to be received in an opening formed in a portion of one of a shoulder stock, butt, or handgrip of the collapsible firearm, such that when installed the latch mechanism is lockably engagable with a corresponding latch catch, wherein the latch catch is formed in an interior portion of a storage compartment of the one of the shoulder stock, butt, or handgrip.

31. A locking mechanism for a collapsible firearm, comprising:

a. a locking member, comprising a first end and a second end, the first end comprising a stop, wherein the locking member is configured to be received by first and second channels formed through portions of an endcap and a storage compartment of one of a shoulder stock, butt, or handgrip of the collapsible firearm, and wherein the locking member is configured to pass through the first and second channels from a first exterior portion to a second exterior portion of the endcap of the one of the shoulder stock, butt, or handgrip, such that a portion of the second end of the locking member protrudes from the second exterior portion of the endcap of the one of the shoulder stock, butt, or handgrip opposite that of the first end of the locking member; and b. a securing mechanism configured to engage with the protruding portion of the second end of the locking member; and wherein the locking member is configured such that when installed through the first and second channels the endcap of the one of the shoulder stock, butt, or handgrip is not removable therefrom.

32. The locking mechanism of claim 31, wherein the first channel is provided from a first side to a second side of the storage compartment and the second channel is provided from a first exterior side to a second exterior side of the endcap, and wherein the first and second channels are configured such that when the endcap is installed on the one of the shoulder stock, butt, or handgrip, the first channel substantially aligns with the second channel such that the locking member can be installed through the first and second channels, thereby locking the endcap to the storage compartment.

33. The locking mechanism of claim 31, wherein the first channel is provided from a top side to a bottom side of the storage compartment and the second channel is provided from a top exterior side to a bottom exterior side of the endcap, and wherein the first and second channels are configured such that when the endcap is installed on the one of the shoulder stock, butt, or handgrip, the first channel substantially aligns with the second channel such that the locking member can be installed through the first and second channels thereby locking the endcap to the storage compartment.

34. The locking mechanism of claim 31, wherein the second end of the locking member comprises a through hole configured to engage with the securing mechanism.

35. The locking mechanism of claim 31, wherein the securing mechanism comprises any one of a lock, cable tie, or zip tie.

36. The locking mechanism of claim 31, wherein the locking member comprises any one of a rod, cable tie, or zip tie.

37. The locking mechanism of claim 31, further comprising a grommet provided at one or more openings of the first and second channels.

38. The locking mechanism of claim 37, wherein the grommet comprises a plastic, rubber, silicon, or composite material grommet.

39. The locking mechanism of claim 37, wherein the grommet comprises a waterproof or semi-waterproof grommet, and is configured to provide a waterproof or semi-waterproof seal at one or more openings of the first and second channels.

40. The locking mechanism of claim 31, wherein the stop is larger than the diameter of the first and second channels.

41. The locking mechanism of claim 31, wherein the endcap is configured such that when the locking member is installed through the first and second channels and the securing mechanism is engaged the storage compartment comprises a locked container.

42. A collapsible firearm with a locking mechanism; comprising:

a. a collapsible firearm;

b. a locking member, comprising a first end and a second end, the first end comprising a stop, wherein the locking member is configured to be received by first and second channels formed through portions of an endcap and a storage compartment of one of a shoulder stock, butt, or handgrip of the collapsible firearm, and wherein the locking member is configured to pass through the first and second channels from a first exterior portion to a second exterior portion of the endcap of the one of the shoulder stock, butt, or handgrip, such that a portion of the second end of the locking member protrudes from the second exterior portion of the endcap of the one of the shoulder stock, butt, or handgrip opposite that of the first end of the locking member; and c. a securing mechanism configured to engage with the protruding portion of the second end of the locking member; and wherein the locking member is configured such that when installed through the first and second channels the endcap of the one of the shoulder stock, butt, or handgrip is not removable, therefore locking components of the collapsible firearm within the storage compartment of the one of the shoulder stock, butt, or handgrip of the collapsible firearm.

* * * * *